US011193284B2

(12) United States Patent
Stuchell

(10) Patent No.: US 11,193,284 B2
(45) Date of Patent: Dec. 7, 2021

(54) TILE-SECURING SYSTEM AND RELATED METHODS

(71) Applicant: Silca System LLC, Alliance, OH (US)

(72) Inventor: Bart Stuchell, Alliance, OH (US)

(73) Assignee: Silca System, LLC, Alliance, OH (US)

( * ) Notice: Subject to any disclaimer, the term of this patent is extended or adjusted under 35 U.S.C. 154(b) by 0 days.

(21) Appl. No.: 16/880,138

(22) Filed: May 21, 2020

(65) Prior Publication Data

US 2020/0370306 A1 Nov. 26, 2020

Related U.S. Application Data

(60) Provisional application No. 62/850,601, filed on May 21, 2019.

(51) Int. Cl.
*E04F 15/02* (2006.01)
*E04F 21/00* (2006.01)

(52) U.S. Cl.
CPC .. *E04F 15/02044* (2013.01); *E04F 15/02183* (2013.01); *E04F 15/02194* (2013.01); *E04F 21/0092* (2013.01)

(58) Field of Classification Search
CPC ..... E04F 15/02044; E04F 15/02183; E04F 15/02194; E04F 21/0092
See application file for complete search history.

(56) References Cited

U.S. PATENT DOCUMENTS 6,321,499 B1 * 11/2001 Chuang ..... E04F 15/022 52/263
6,862,855 B1 * 3/2005 Milum ..... E04B 5/14 52/384
2004/0258473 A1 * 12/2004 Lin ..... E04F 15/02452 403/408.1
2011/0260027 A1 * 10/2011 Farnham, Jr. ..... F24S 25/636 248/309.1
2014/0161516 A1 * 6/2014 Deumer ..... E04F 13/0823 403/345
2015/0096250 A1 * 4/2015 Lam ..... E04F 15/105 52/403.1

(Continued)

FOREIGN PATENT DOCUMENTS

FR 2992009 A1 * 12/2013 ..... E04F 15/02183

OTHER PUBLICATIONS

Machine translation of foreign reference FR2992009, obtained from https://translationportal.epo.org/emtp/translate/?ACTION=description-retrieval&COUNTRY=FR&ENGINE=google&FORMAT=docdb&KIND=A1&LOCALE=en_EP&NUMBER=2992009&SRCLANG=fr&TRGLANG=en (last accessed on Apr. 1, 2021) (Year: 2021).*

*Primary Examiner* — Theodore V Adamos
(74) *Attorney, Agent, or Firm* — Daniel J. Schlue; Schlue IP Law

(57) ABSTRACT

A tile-securing system having a polymeric one-piece bracket having a first flange, a second flange, and a central raised-wall portion, the first flange and the second flange opposing each other and being in the same plane, the central raised-wall portion being orthogonal to both the first flange and the second flange; a slot opening located on an exterior edge of the raised-wall portion; the slot opening having a first width and a first length, wherein the first width is less than the first length, and the slot opening configured to receive a wedge that upon insertion into the slot opening expands the first width to a greater second width.

8 Claims, 29 Drawing Sheets

(56) References Cited

U.S. PATENT DOCUMENTS

| | | | | |
|---|---|---|---|---|
| 2015/0292217 | A1* | 10/2015 | Prati | E04F 15/107<br>52/483.1 |
| 2016/0168867 | A1* | 6/2016 | Chester | E04F 15/02044<br>52/582.2 |
| 2016/0362902 | A1* | 12/2016 | Lee | E04F 15/02044 |
| 2017/0037631 | A1* | 2/2017 | McManus | E04F 15/02044 |
| 2017/0314278 | A1* | 11/2017 | Lee | E04G 23/0285 |
| 2018/0238060 | A1* | 8/2018 | Doupe | E04F 13/081 |
| 2019/0048858 | A1* | 2/2019 | Webster | A43B 3/0015 |
| 2020/0340256 | A1* | 10/2020 | Lee | E04F 15/02044 |

* cited by examiner

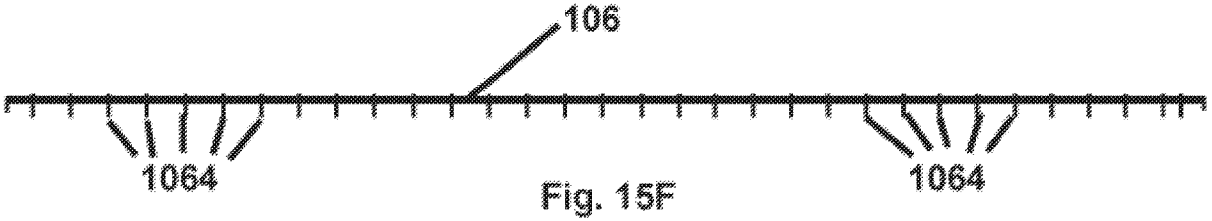
Fig. 15F
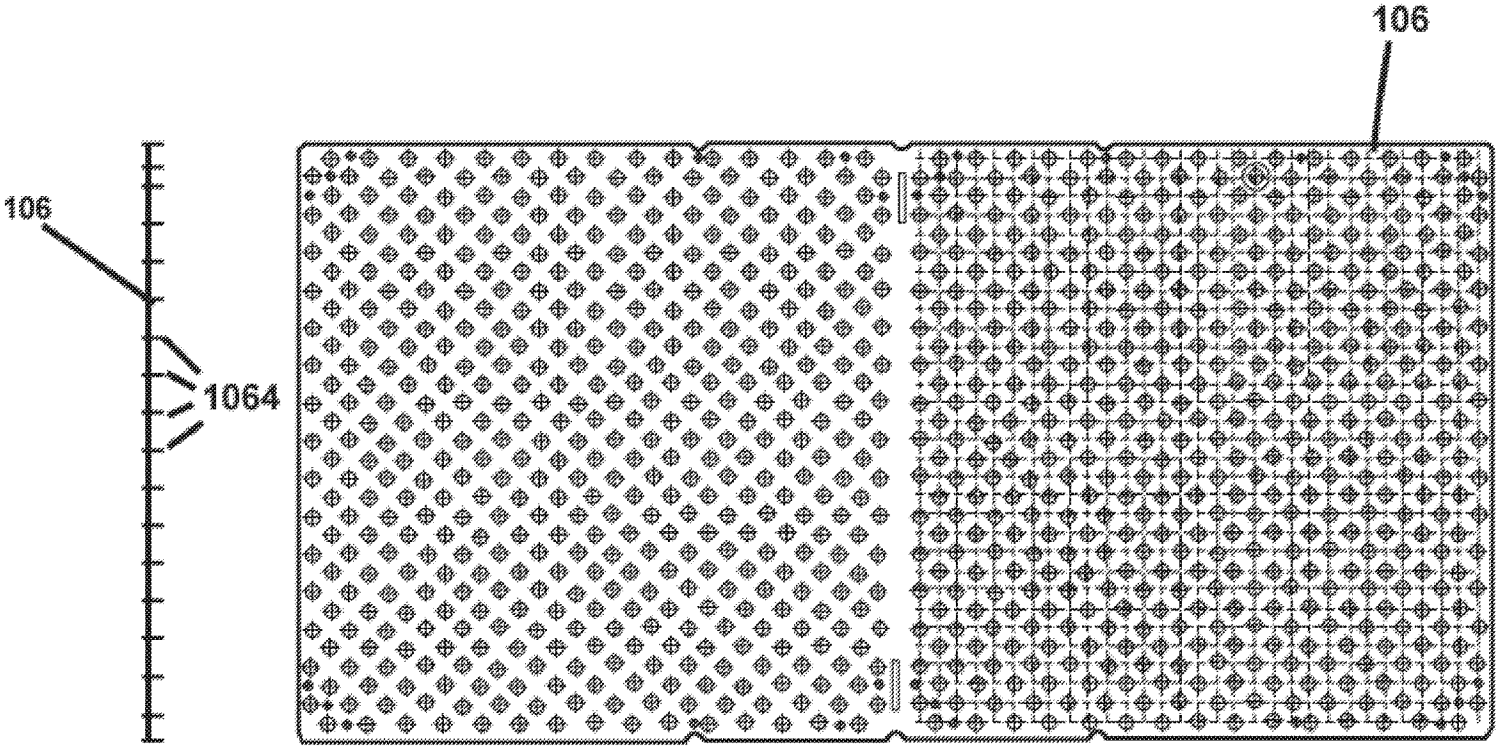
Fig. 15
Fig. 15E

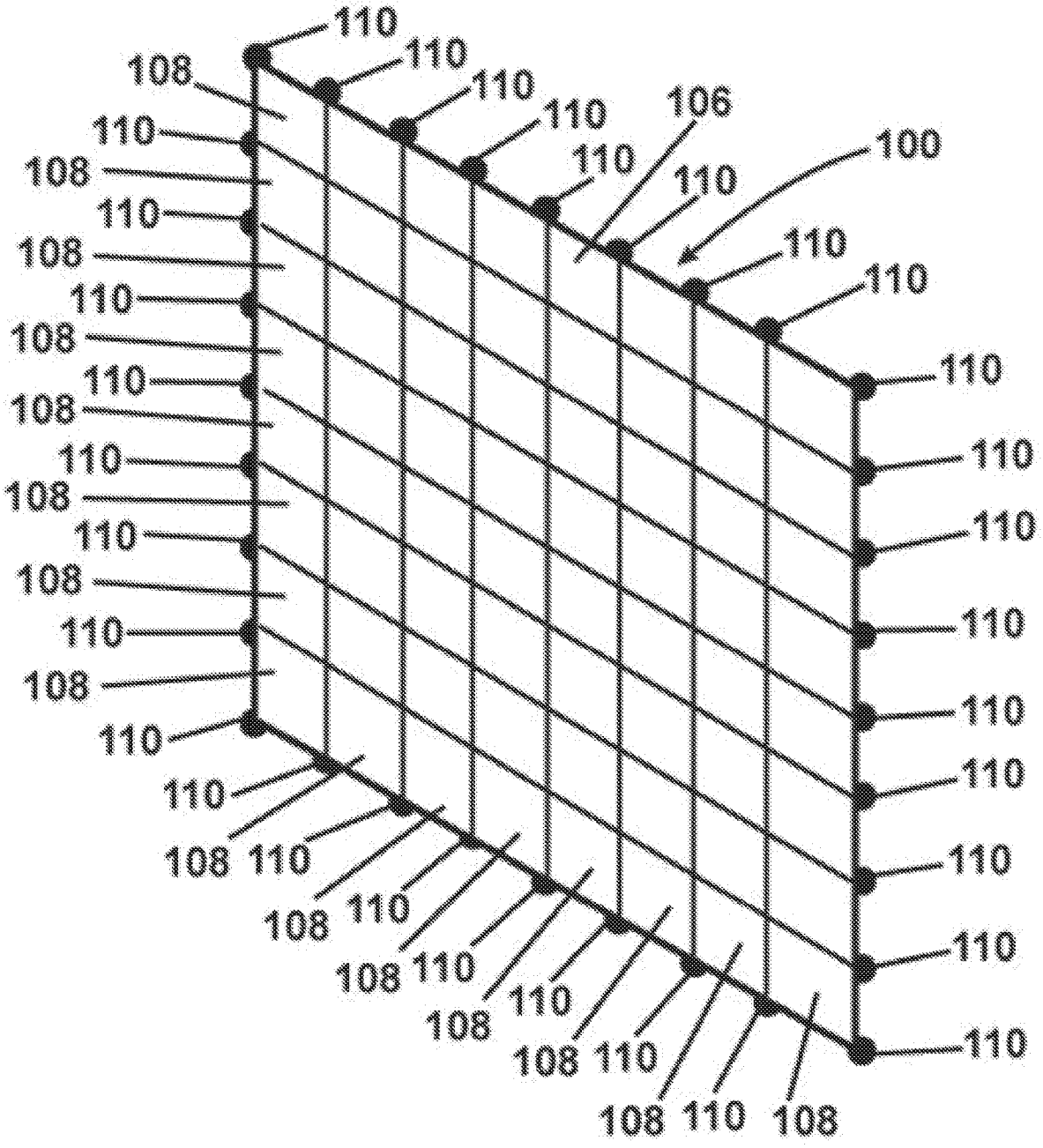
110
110
110

TILE-SECURING SYSTEM AND RELATED METHODS

CROSS-REFERENCE TO RELATED APPLICATIONS

This patent application claims priority to U.S. provisional patent application Ser. No. 62/850,601 titled, "Tile-Securing System and Related Methods"; it was filed on May 21, 2019. The subject matter of provisional patent application 62/850,601 is hereby incorporated by reference.

BACKGROUND OF THE INVENTION

Outside patios and decks are well known and so are tile floor coverings that offer both cosmetic and durability benefits. In order to secure the tiles in place to ensure that they do not move or become displaced in high wind or other environmental conditions, tile-securing systems and methods are needed.

BRIEF SUMMARY OF THE INVENTION

A tile-securing system having a polymeric one-piece bracket having a first flange, a second flange, and a central raised-wall portion, the first flange and the second flange opposing each other and being in the same plane, the central raised-wall portion being orthogonal to both the first flange and the second flange; a slot opening located on an exterior edge of the raised-wall portion; the slot opening having a first width and a first length, wherein the first width is less than the first length, and the slot opening configured to receive a wedge that upon insertion into the slot opening expands the first width to a greater second width.

A tile-securing system having a polymeric one-piece bracket having a first flange, a second flange, and a central raised-wall portion, the first flange and the second flange opposing each other and being in the same plane, the central raised-wall portion being orthogonal to both the first flange and the second flange; a slot opening located on an exterior edge of the raised-wall portion; the slot opening having a first width and a first length, the slot opening configured to receive a wedge that upon insertion into the slot expands the first width to a greater second width; a wedge that is positioned within the slot opening and fixidly attached to the polymeric one-piece bracket, the wedge having a width that is relatively greater than the first width of the slot opening, the wedge having a length that is relatively less than the first length of the slot opening, a polymeric mat that is fixidly attached to the first flange or second flange; at least one tile that is adjacent to and in contact with the polymeric one-piece bracket; and a pedestal that is fixidly attached to the polymeric mat.

BRIEF DESCRIPTION OF THE SEVERAL VIEWS OF THE DRAWINGS

FIG. 15 is a top view of a polymeric mat.

FIG. 15E is a cross-sectional side view of a polymeric mat.

FIG. 15F is a cross-sectional side view of a polymeric mat.

FIG. 19 is a perspective view of an embodiment of a tile-securing system.

DETAILED DESCRIPTION OF THE INVENTION

Embodiments are directed to a tile-securing system and related methods. For the purposes of this patent application, "tile" means all known outdoor tiles that are solid and substantially inflexible. Non-limiting examples include rectified and non-rectified versions of: porcelain pavers, porcelain stone, porcelain tile, travertine stone, natural stone, and concrete pavers. Mechanical fasteners, such as screws or threaded bolts, can be used herein to fixably attach one of the below-described elements to another, and a person skilled in the art will be able to do so without having to exercise undue experimentation.

Figure 18:
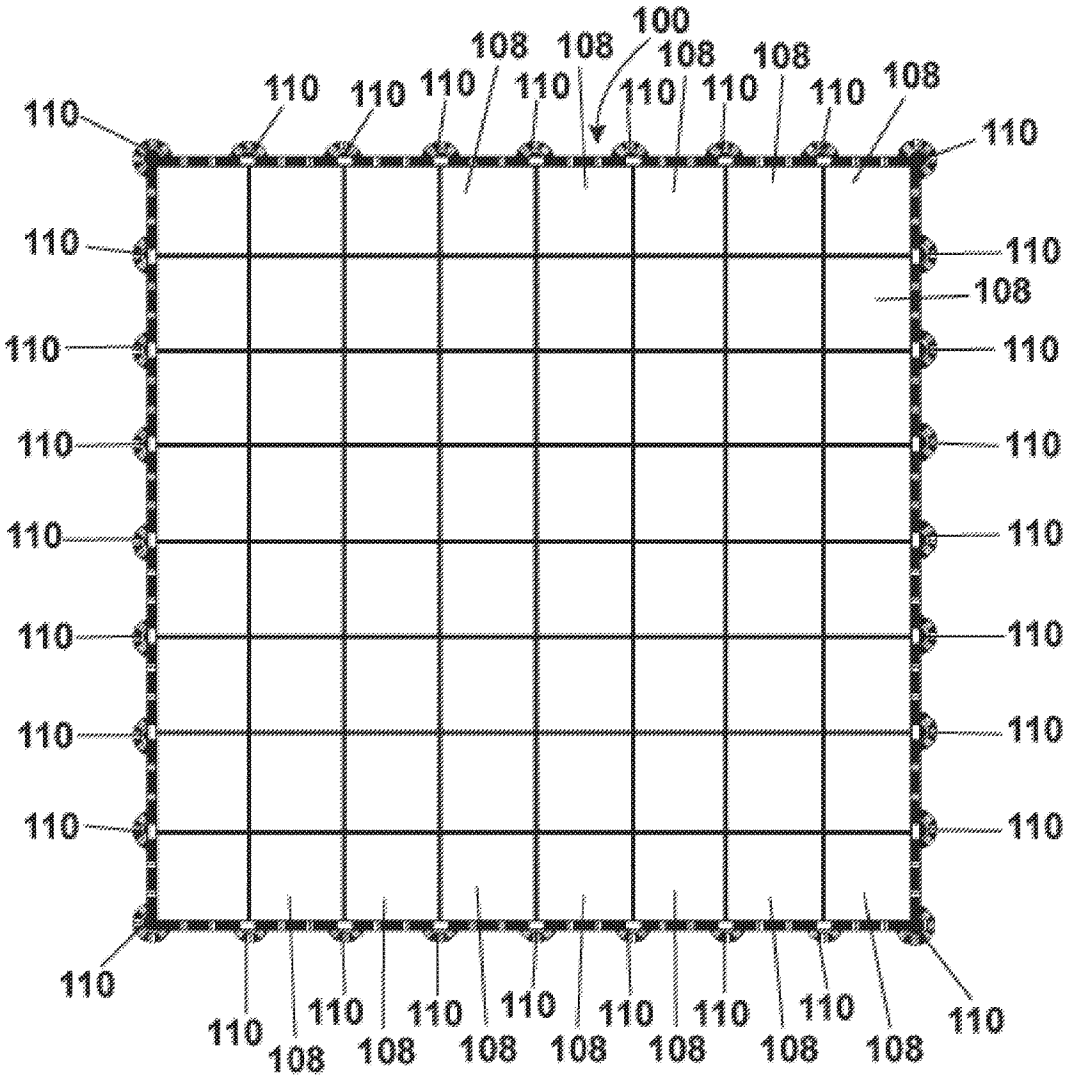
FIG. 18 is a top view of an embodiment of a tile-securing system.
Figure 17:
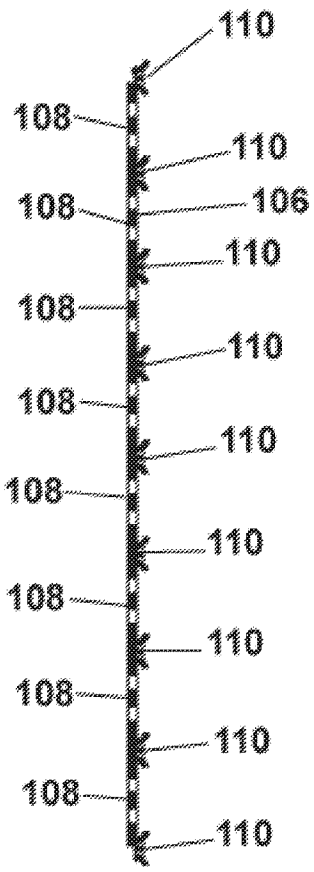
FIG. 17 is a side view of an embodiment of a tile-securing system.
Figure 20:
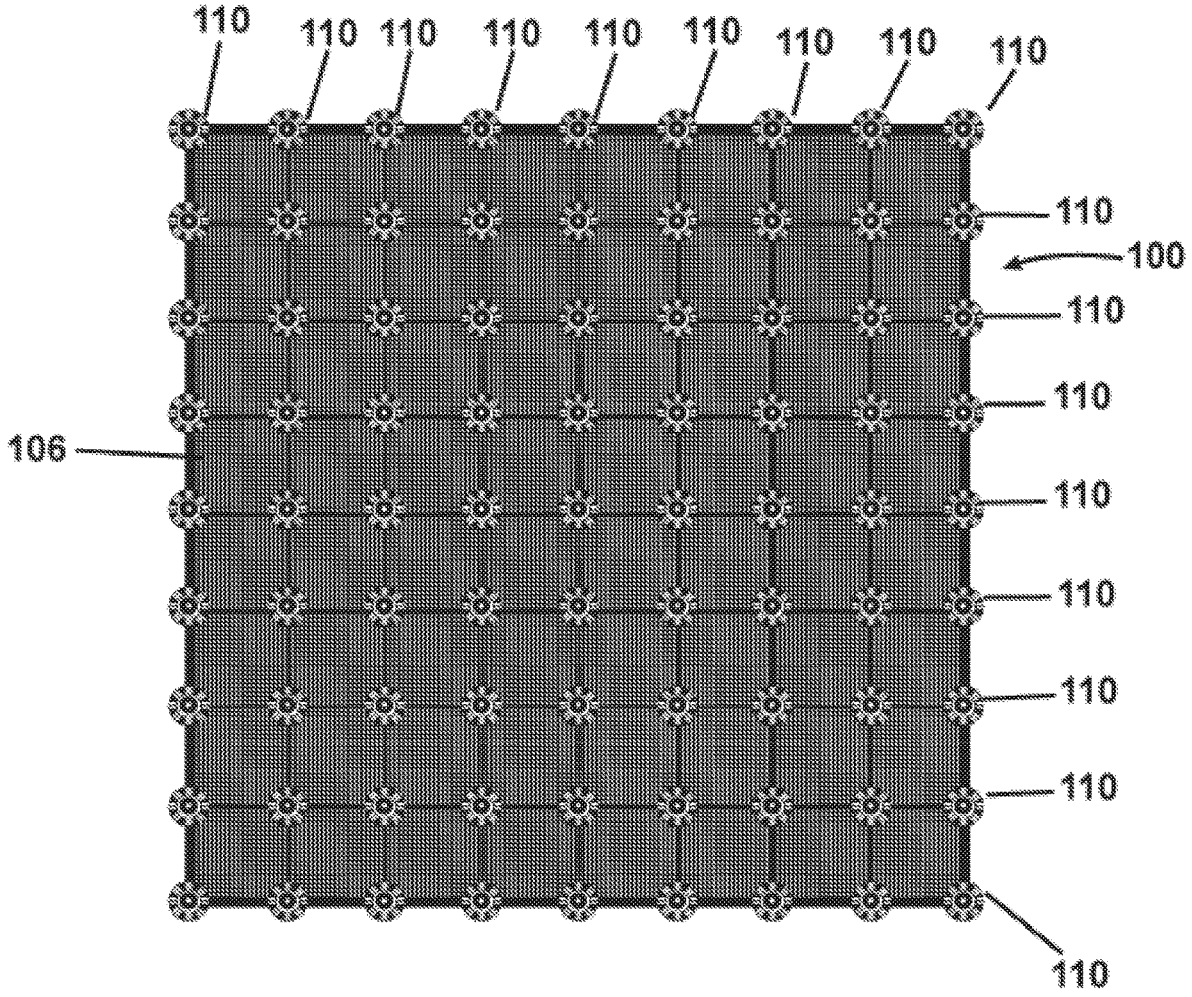
FIG. 20 is a bottom view of an embodiment of a tile-securing system.

Embodiments will be described with reference to the figures. FIGS. 17, 18, 19, and 20 show different views of an embodiment of tile-securing system 100. FIG. 17 is a side view of tile-securing system 100, FIG. 18 is a top view of tile-securing system 100, FIG. 19 is a perspective view of tile-securing system 100, and FIG. 20 is a bottom view of tile-securing system 100. FIGS. 17, 18, and 19 show tile-securing system 100 having pedestals 110 fixably attached to and supporting polymeric mat 106, polymeric mat 106 is fixably attached to a plurality of polymeric one-piece brackets 102 (shown in magnified views 18A, 18B, 18C, and 18D) that secure tiles 108 in position using pressure fitting (that results from the plurality of polymeric one-piece brackets 102 positioned adjacent to and secured in place against edge portions of tiles 108). FIGS. 18 and 19 show a plurality of pedestals 110 located at the perimeter of the square sixty-four tile 108 arrangement; and specifically, each shown pedestal 110 is positioned in a manner that supports at least one corner portion of a tile 108. In FIG. 18, at each of the four corners of the square sixty-four-tile arrangement of tile-securing system 100 is a corner-positioned pedestal 110 that supports a tile 108's corner portion. Specifically, in FIG. 18's top view of tile-securing system 100, each of these four corner pedestals 110 (of the square sixty-four tile arrangement) is shown with only approximately ¾ of their respective top portions being viewable because approximately ¼ of their respective top-view portions are covered by a tile 108 corner and polyermic-mat 106 corner. Also in FIG. 18, along each of the four sides of the square sixty-four tile 108 arrangement, ½ of the top surface area of pedestals 110 are shown along the perimeter edges because approximately ½ of their respective top-view portions are covered by a tile 108 corner and polyermic-mat 106 corner; there are twenty-eight perimeter edge pedestals 110 shown in FIG. 18. In FIGS. 18 and 19, the sixty-four tiles 108 are secured in place using a plurality of polymeric one-piece brackets 102 (shown in magnified views 18A, 18B, 18C, and 18D) that apply pressure to edges of tiles 108.

Figure 18B:
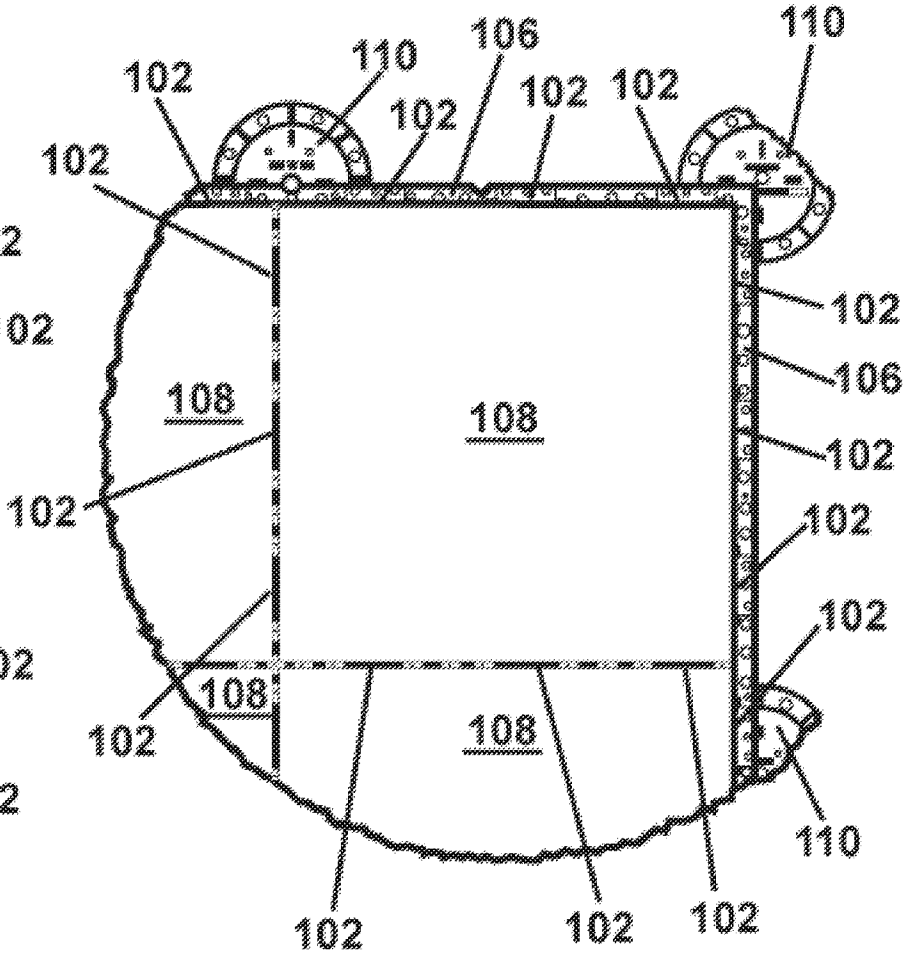
FIG. 18B is a top view of a corner portion of an embodiment of a tile-securing system.
Figure 18A:
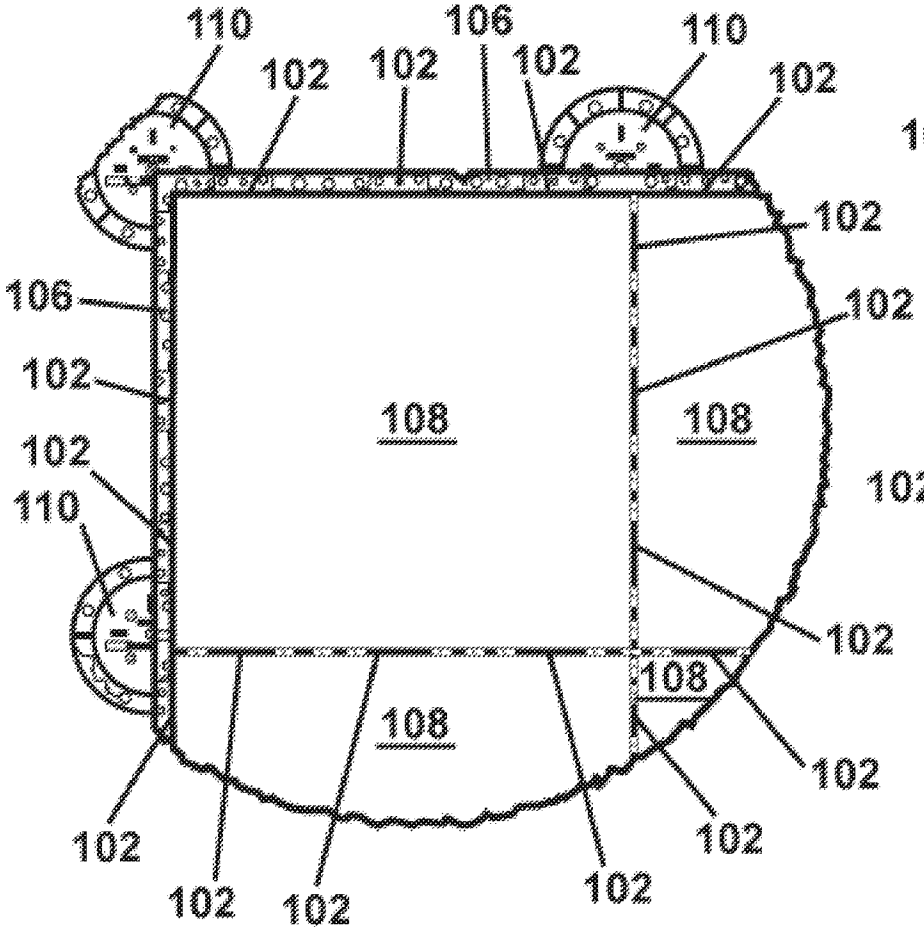
FIG. 18A is a top view of a corner portion of an embodiment of a tile-securing system.
Figure 18D:
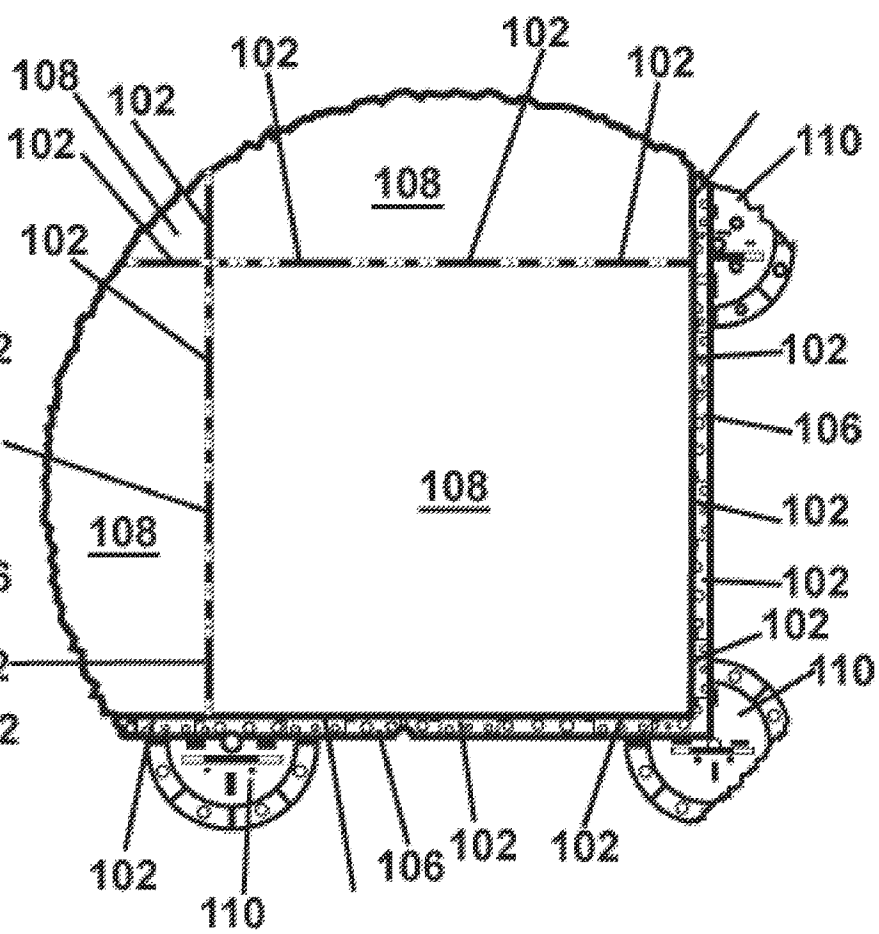
FIG. 18D is a top view of a corner portion of an embodiment of a tile-securing system.

FIGS. 18A, 18B, and 18D can all be described similarly. Each of these figures is a magnified top view of a different corner portion of the tile-securing system 100 embodiment shown in FIG. 18. Each of these three figures, i.e., 18A, 18B, and 18D, shows three pedestals 110 supporting polymeric mat 106 that has polymeric one-piece brackets 102 fixably attached and secured thereon, and tiles 108 are secured in place by the plurality of polymeric one-piece brackets 102 using pressure fitting. In embodiments, each separate tile 108 has three polymeric one-piece brackets 102 along each of its four linear edges; so in all, there are twelve polymeric one-piece brackets 102 that secure each tile 108 in place (three brackets per linear edge multiplied by four linear edges). In each of FIGS. 18A, 18B, and 18D, a fully drawn corner tile 108 is shown having a total of twelve polymeric one-piece brackets 102 adjacent to and against its four linear edges; two of these linear edges are adjacent to other tiles 108 and the other two linear edges are not. Regarding the polymeric one-piece brackets 102 that are positioned between two adjacent tiles 108, the portion of the polymeric one-piece brackets 102 shown (between the adjacent tiles 108) is the central raised-wall portion 1026 of polymeric one-piece bracket 102 (the central raised-wall portion 1026 of the bracket being fully illustrated in FIGS. 1-5). Regarding the polymeric one-piece brackets 102 that are shown at the outer edges of tiles 108, in FIGS. 18A, 18B, and 18D, the figures show a top view of first flange portion 1022 or a second flange portion 1024 and the top view of central raised-wall portion 1026 (these polymeric one-piece bracket 102 portions being fully illustrated in FIGS. 1-5). In embodiments, the flange portions shown in FIGS. 18A, 18B, and 18D are first flange portions 1022 because the correlating second flange portions 1024 are positioned underneath tiles 108 and therefore not shown in these top views.

Figure 18C:
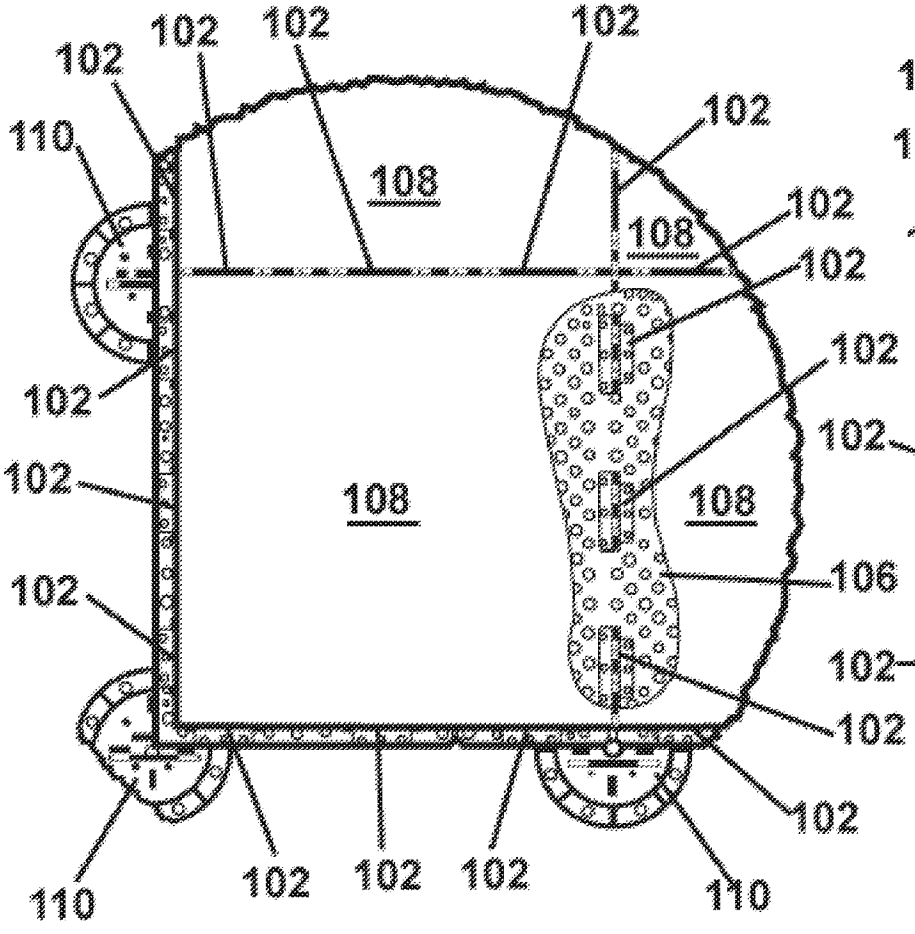
FIG. 18C is a top view of a corner portion of an embodiment of a tile-securing system.

FIG. 18C is very similar to FIGS. 18A, 18B, and 18D, but FIG. 18C provides an additional section view (that removes portions of adjacent tiles 108) that makes it possible to illustrate tile-securing system's 100 configuration underneath two adjacent tiles 108. FIG. 18C illustrates what is happening both underneath tiles 108 and in between adjacent tiles 108. In the section view of FIG. 18C, the position and orientation of polymeric one-piece brackets 102 are shown as being in line and fixably attached to polymeric mat 106 such that their central raised-wall portions 1026 are touching both tiles 108 on either side of the central raised-wall portions 1026. In embodiments, the assembly structure shown in FIG. 18C's section view is the same between adjacent tiles 108 that make up tile-securing system 100; in other embodiments, the polymeric one-piece brackets 102 are in line but oriented 180 degrees from their positions shown in FIG. 18C.

FIG. 17 is a side view of an embodiment of a tile-securing system that shows nine pedestals 110 in line and fixably attached to polymeric mat 106; polymeric mat 106 is fixably attached to a plurality of polymeric one-piece brackets 102 that secure eight tiles 108 in place using a pressure fitting caused by the plurality of polymeric one-piece brackets 102 being secured to polymeric mat 106 (using mechanical fasteners) in a manner that applies pressure against a side edge of a respective tile 108 that each polymeric one-piece bracket 102 is adjacent to and in contact with.

Figure 20A:
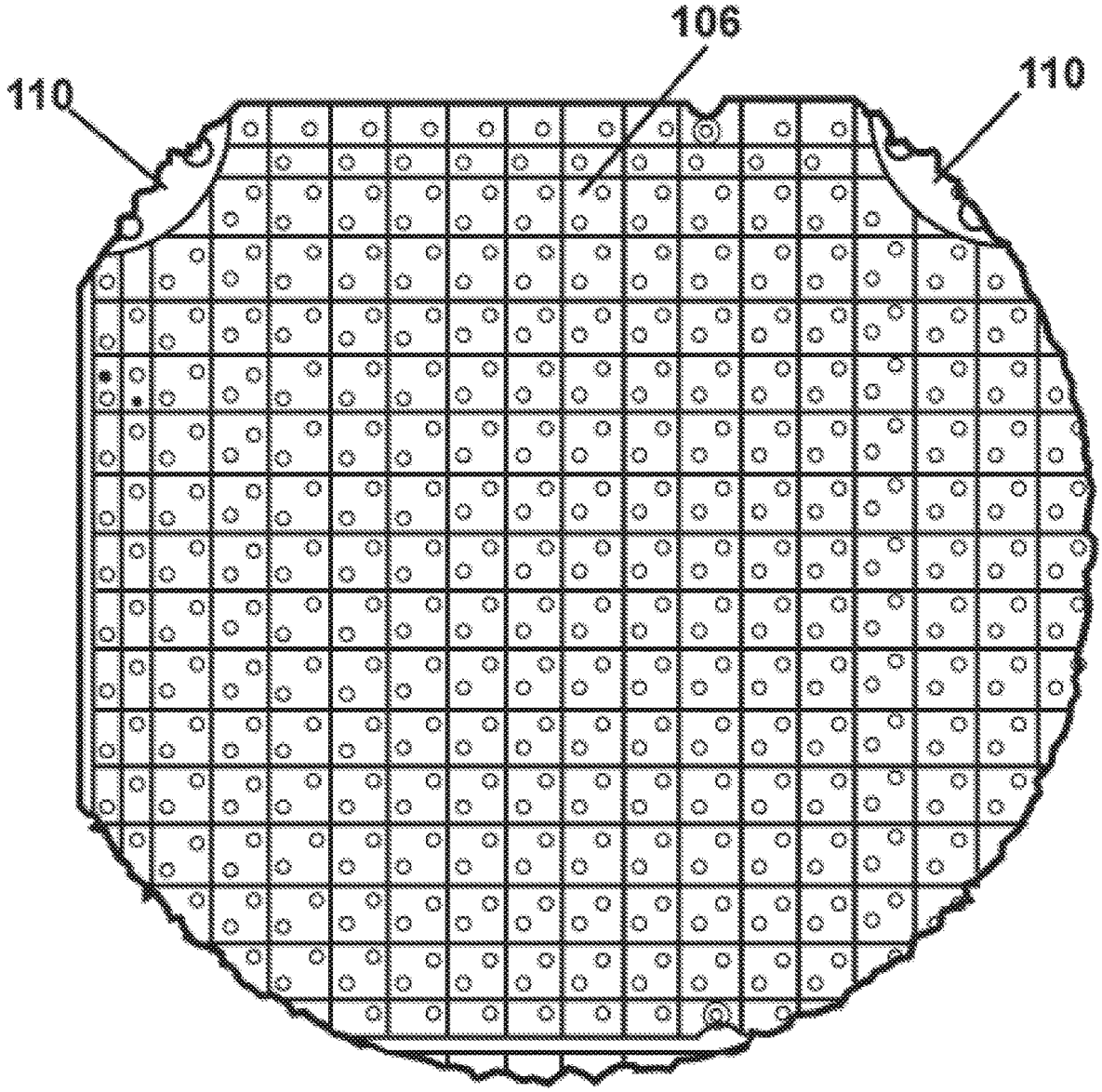
FIG. 20A is a bottom view of a corner portion of an embodiment of a tile-securing system.
Figure 21A:
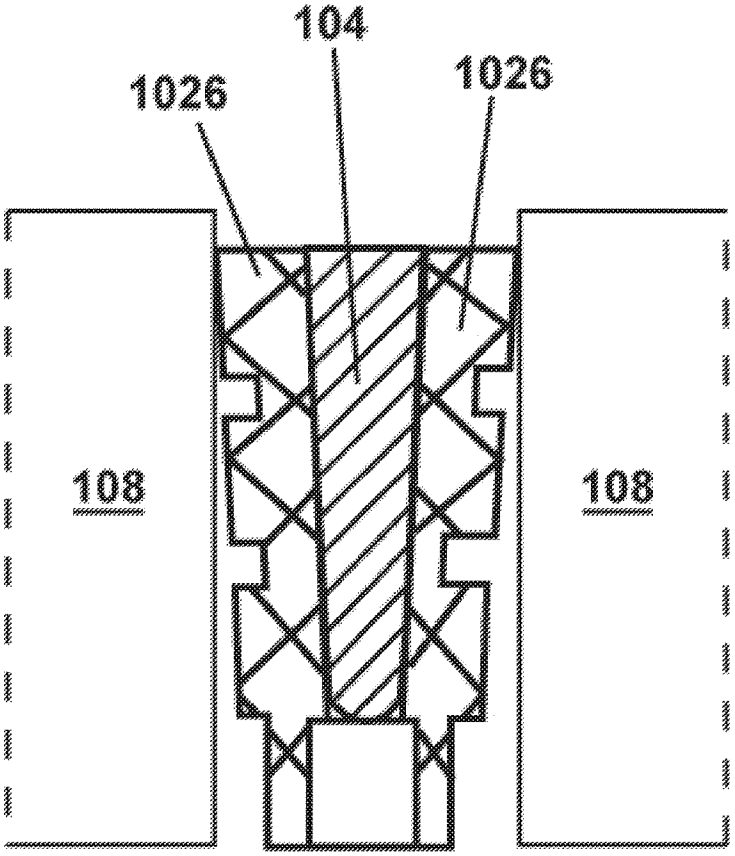
FIG. 21A is a cross-sectional side view of an embodiment of a tile-securing system.
Figure 21:
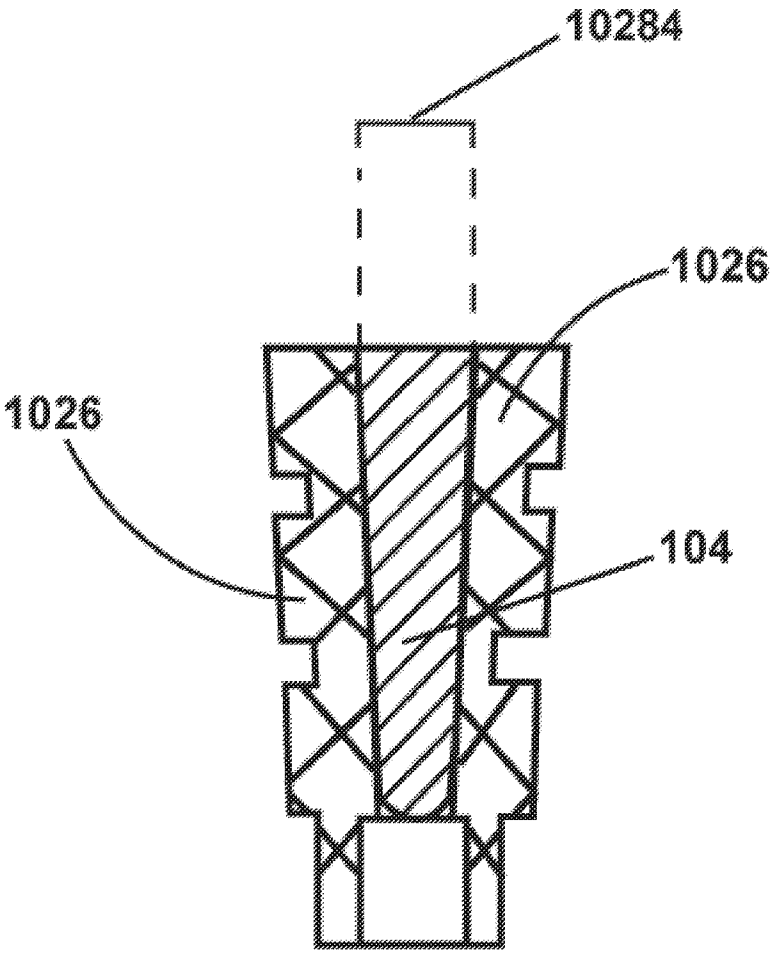
FIG. 21 is a cross-sectional side view of an embodiment of a tile-securing system.

FIG. 20 is a bottom view of tile-securing system 100 that shows eighty-one pedestals 110 arranged in series at the base of tile-securing system 100. A plurality of pedestals 110 are fixably attached to polymeric mat 106 in positions that allow each respective pedestal 110 to support at least one corner portion of tiles 108. Stated differently, in this embodiment, pedestals 110 are arranged in rows and columns of nine; a total of eighty-one pedestals 100 are shown and support sixty-four tiles 108 (tiles 108 are not shown in FIG. 20's bottom view but shown in FIGS. 17, 18, and 19). FIG. 20A is a magnified bottom view of a corner portion of the tile-securing system 100 embodiment shown in FIG. 20. Shown are two pedestals 100 fixably attached to polymeric mat 106.

Pedestals 110 are well known and commercially available. Persons skilled in the art will be able to select useful pedestals 100 without having to exercise undue experimentation.

Figure 9:
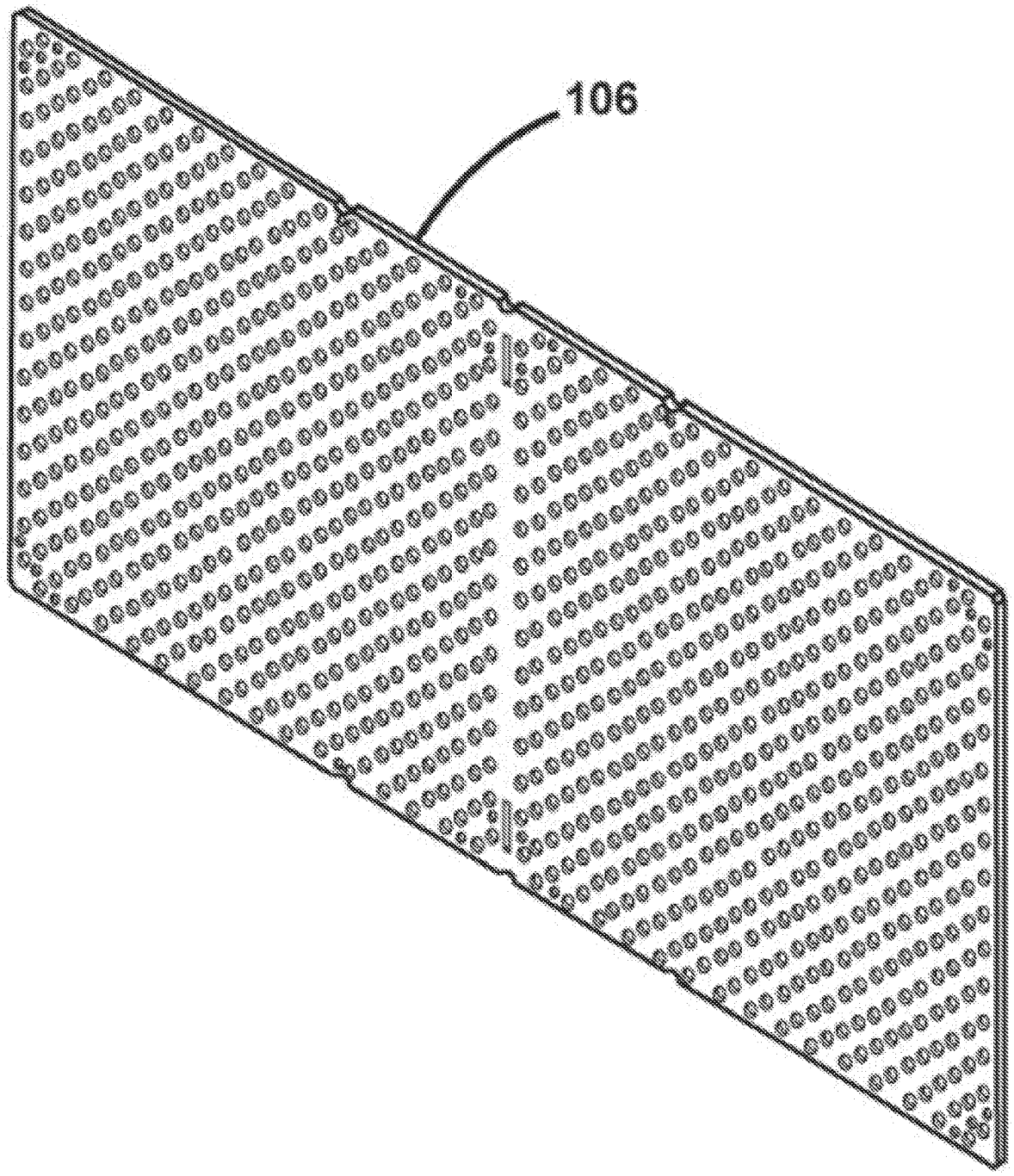
FIG. 9 is a perspective view of a polymeric mat.
Figure 10:
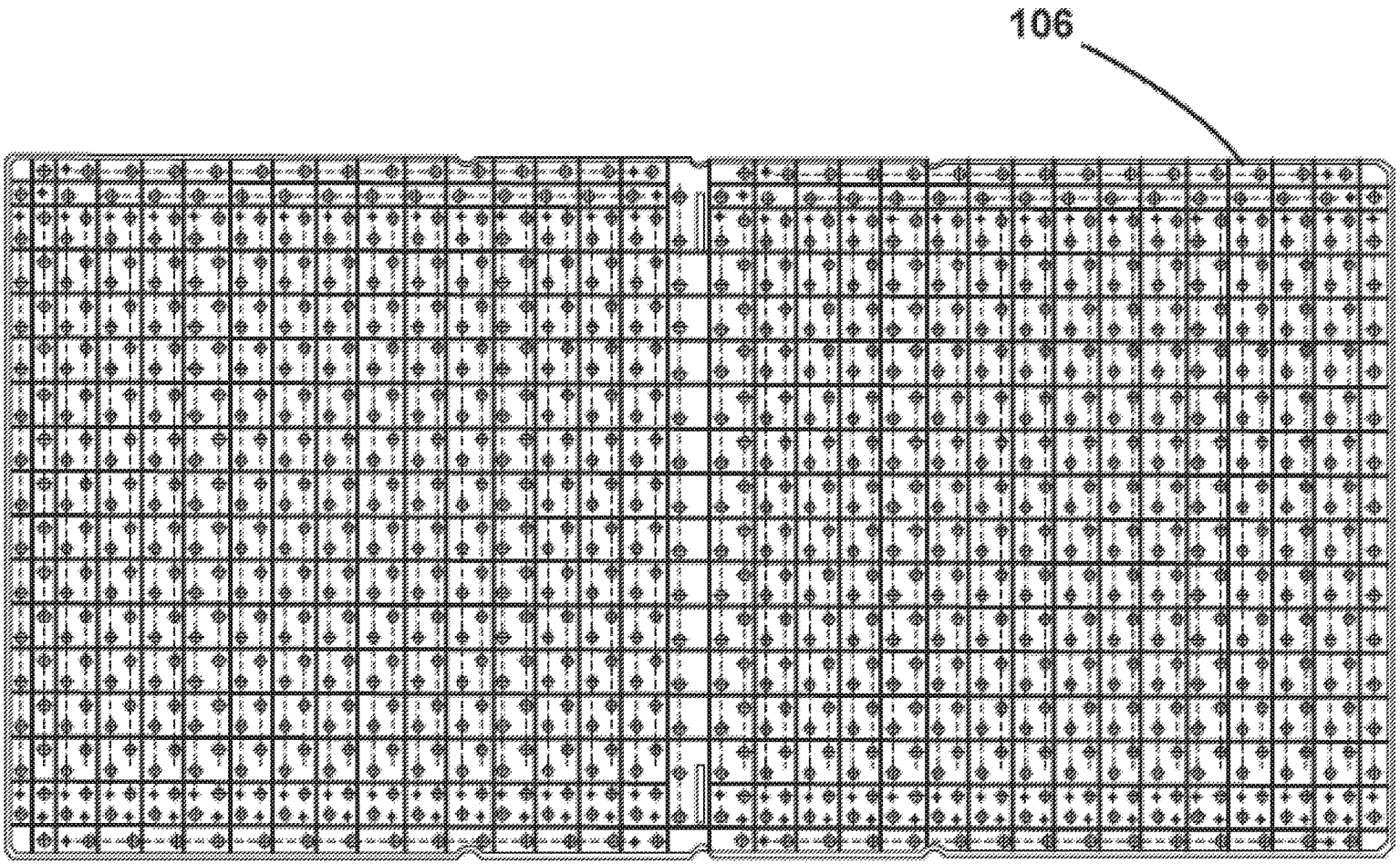
FIG. 10 is a bottom view of a polymeric mat.
Figure 10B:
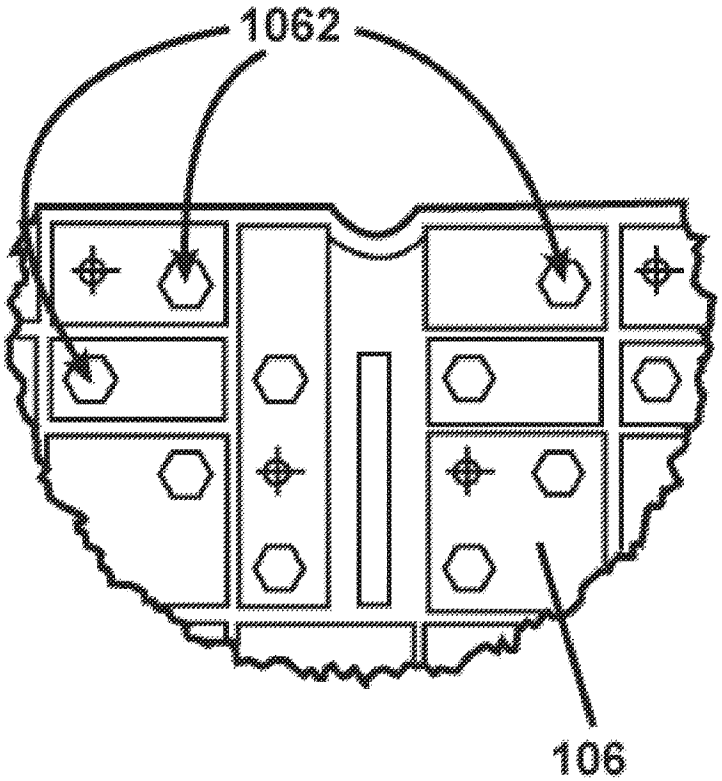
FIG. 10B is a bottom view of a side-edge portion of a polymeric mat.
Figure 10A:
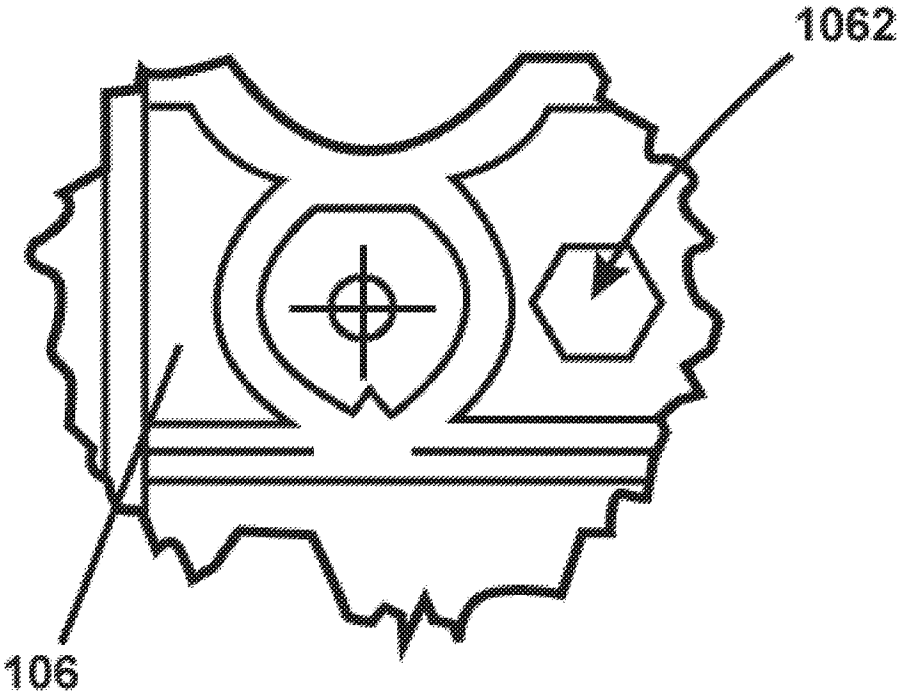
FIG. 10A is a bottom view of a side-edge portion of a polymeric mat.
Figure 11B:
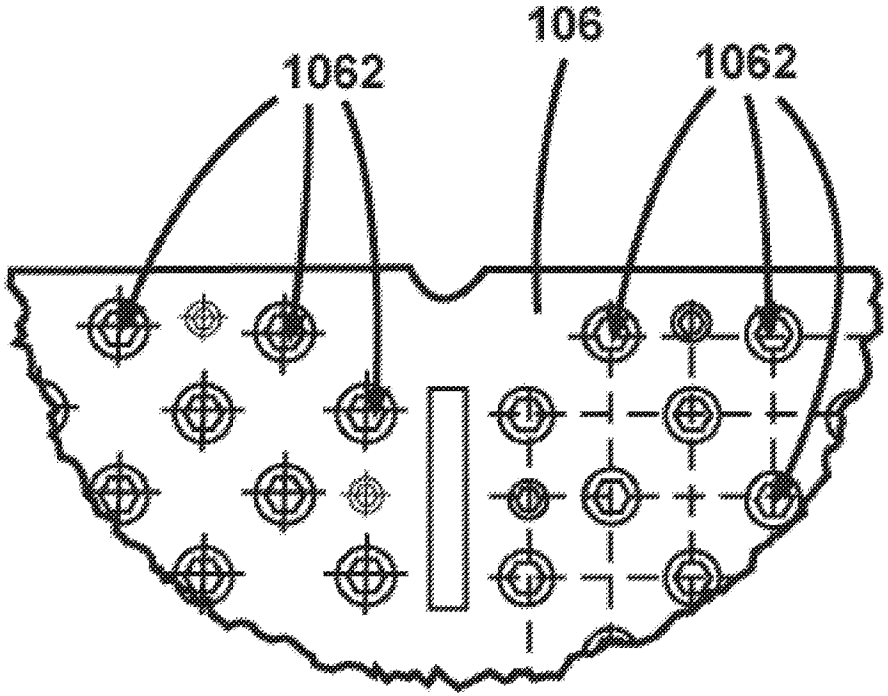
FIG. 11B is a top view of a side-edge portion of a polymeric mat.
Figure 11A:
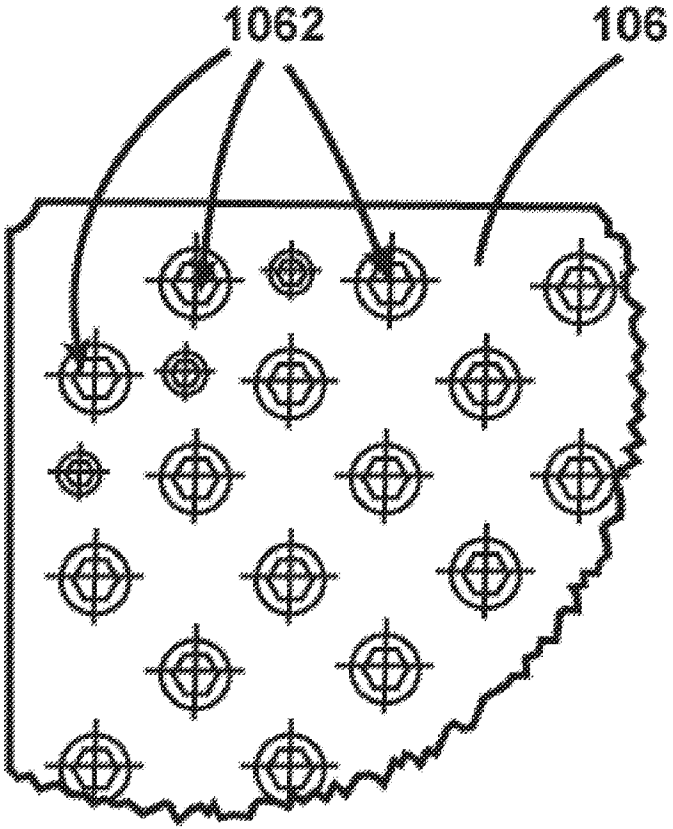
FIG. 11A is a top view of a corner portion of a polymeric mat.
Figure 11D:
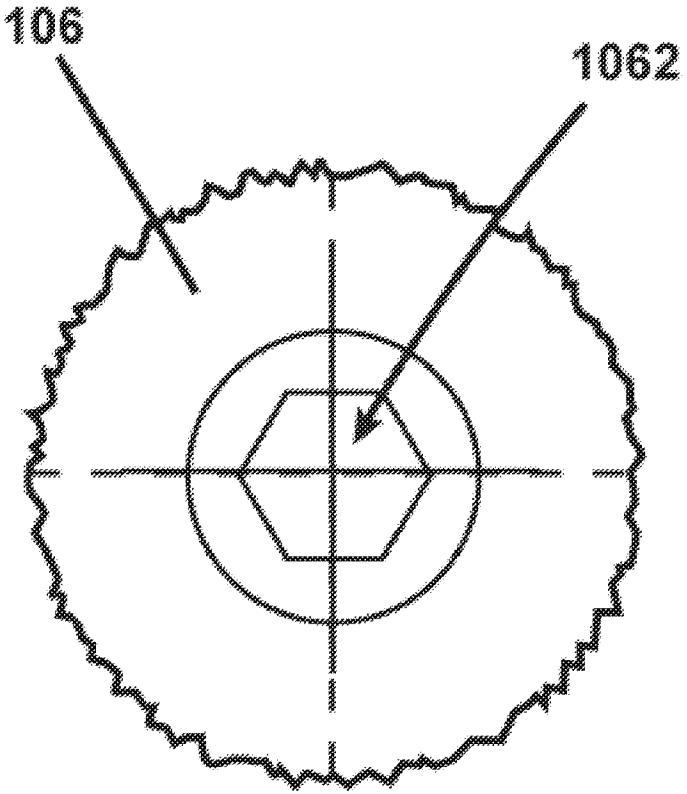
FIG. 11D is a top view of a portion of a polymeric mat.
Figure 11C:
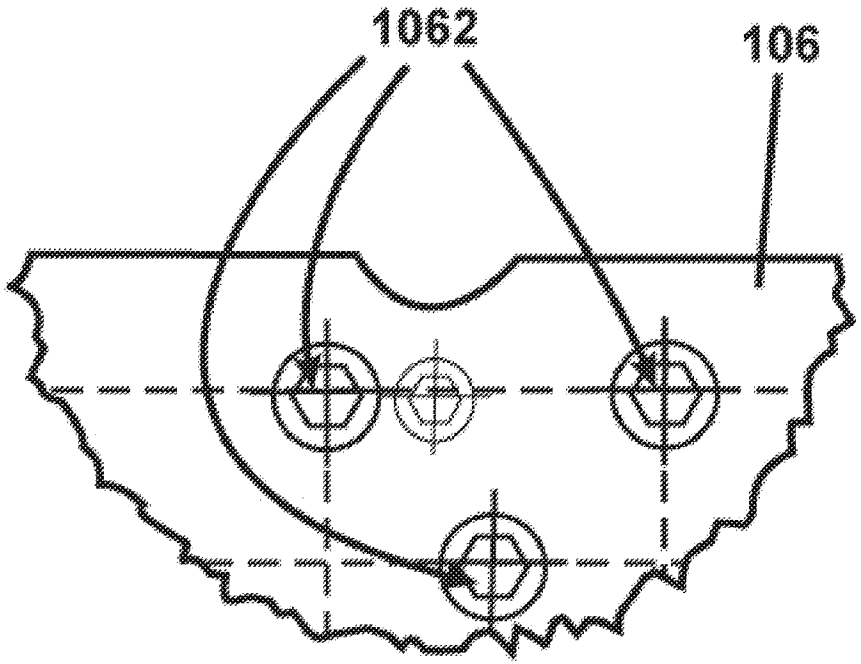
FIG. 11C is a top view of a side-edge portion of a polymeric mat.
Figure 11F:
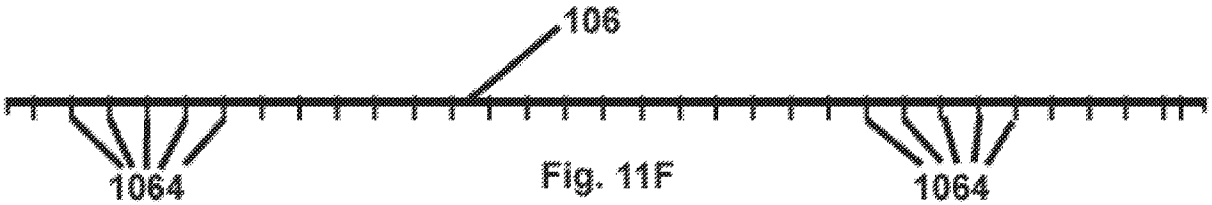
FIG. 11F is a cross-sectional side view of a polymeric mat.
Figure 11:
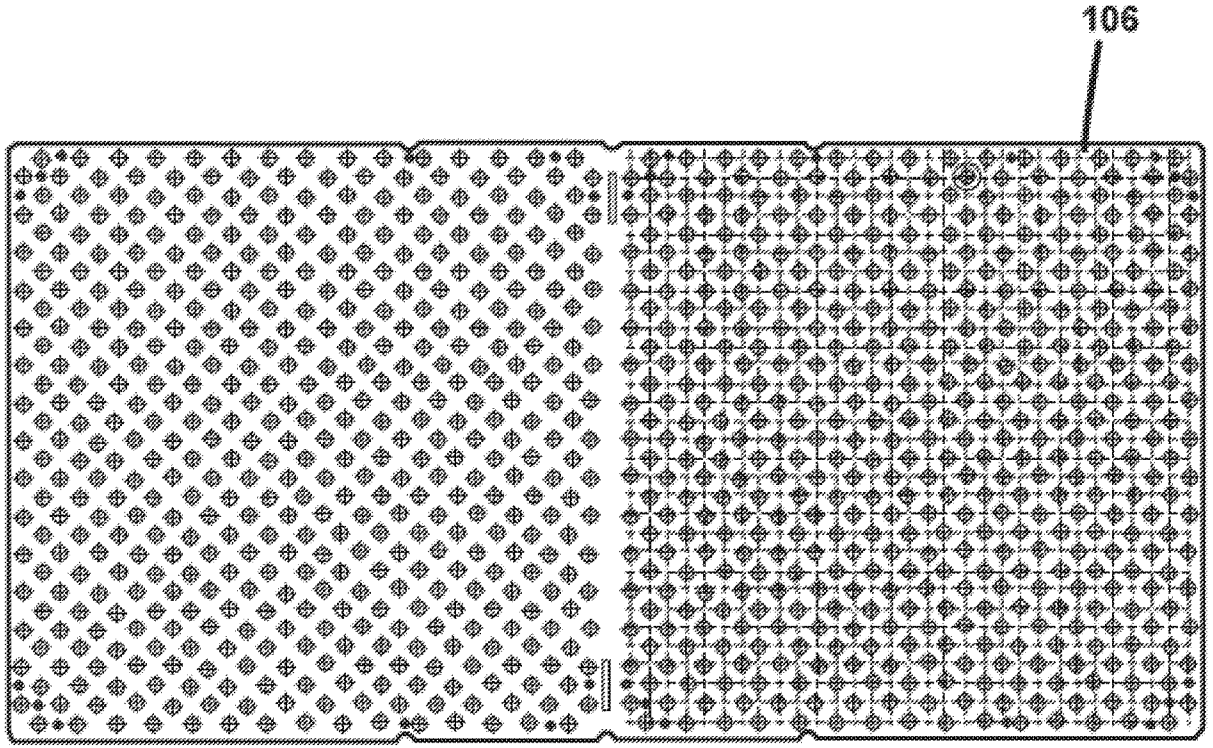
FIG. 11 is a top view of a polymeric mat.
Figure 11E:
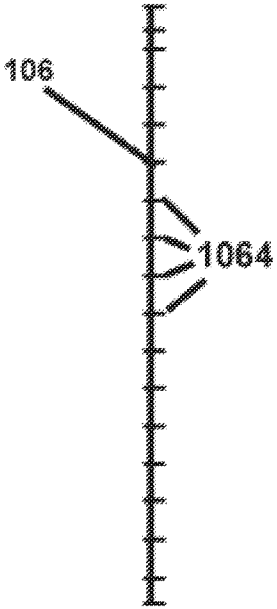
FIG. 11E is a cross-sectional side view of a polymeric mat.
Figure 12:
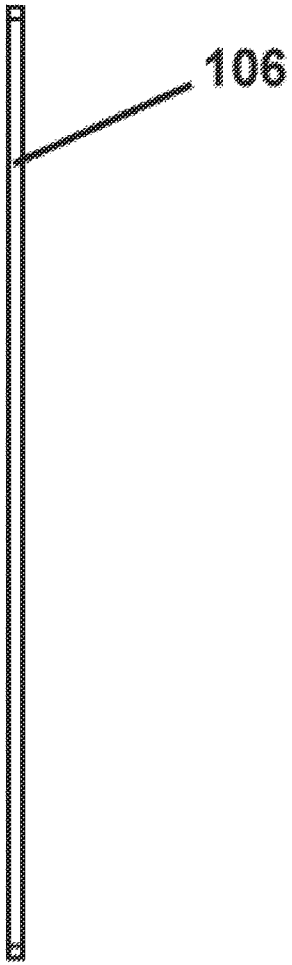
FIG. 12 is a side view of a polymeric mat.
Figure 11G:
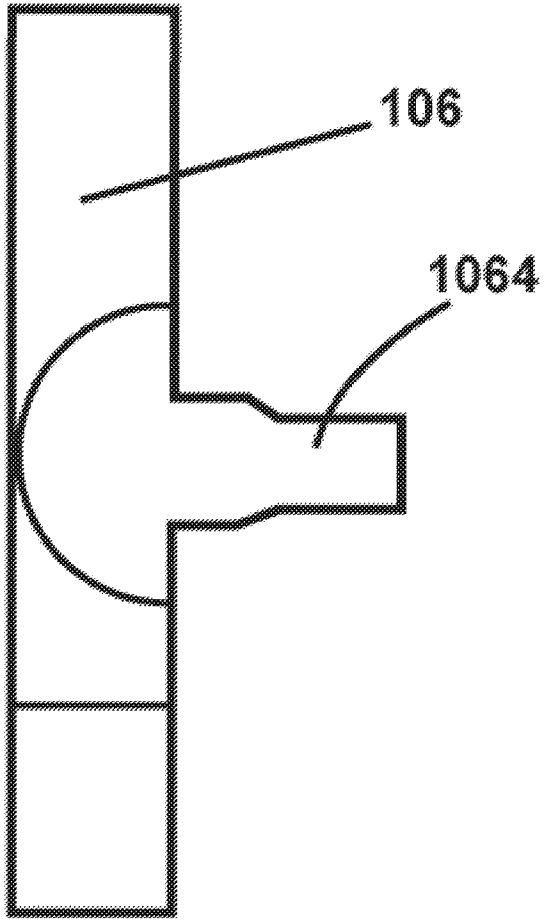
FIG. 11G is a magnified cross-sectional view of a polymeric mat.

FIGS. 9, 10, 11, and 12 show various views of a particular embodiment of polymeric matt 106; FIG. 9 is a perspective view; FIG. 10 is a bottom view, FIG. 11 is a top view, and FIG. 12 is a side view. FIG. 10A is a magnified bottom view of a side-edge portion of an embodiment of polymeric mat 106; specifically shown is hex hole 1062 proximate to a side edge of polymeric mat 106. FIG. 10B is a magnified bottom view of a side portion of an embodiment of polymeric mat 106; specifically shown are a plurality of hex holes 1062 that are configured to enable fasteners to fixably attach polymeric mat 106 to one or more pedestals 110. FIG. 11A is a magnified top view of a corner portion of an embodiment of polymeric mat 106 having a plurality of hex holes 1062 that are configured to enable fasteners to fixably attach polymeric mat 106 to one or more pedestals 110. FIG. 11B is a magnified top view of a side-edge portion of an embodiment of polymeric mat 106 having a plurality of hex holes 1062 that are configured to enable fasteners to fixably attach polymeric mat 106 to one or more pedestals 110. FIG. 11C is a magnified top view of a side-edge portion of an embodiment of polymeric mat 106 having a plurality of hex holes 1062 that are configured to enable fasteners to fixably attach polymeric mat 106 to one or more pedestals 110. FIG. 11D is a magnified top view of an embodiment of polymeric mat 106 having hex hole 1062 configured to enable a fastener, such as screw or threaded bolt, to fixably attach polymeric mat 106 to a pedestal 110. FIGS. 11E and 11F are cross-sectional views of polymeric mat 106; also shown are a plurality of ribs 1064 on the underside of polymeric mat 1064. FIG. 11G is a magnified view of a portion of cross-sectional side view shown in 11E, FIG. 11G shows a single polymeric rib 1064 on the underside of polymeric mat 106.

Figure 13:
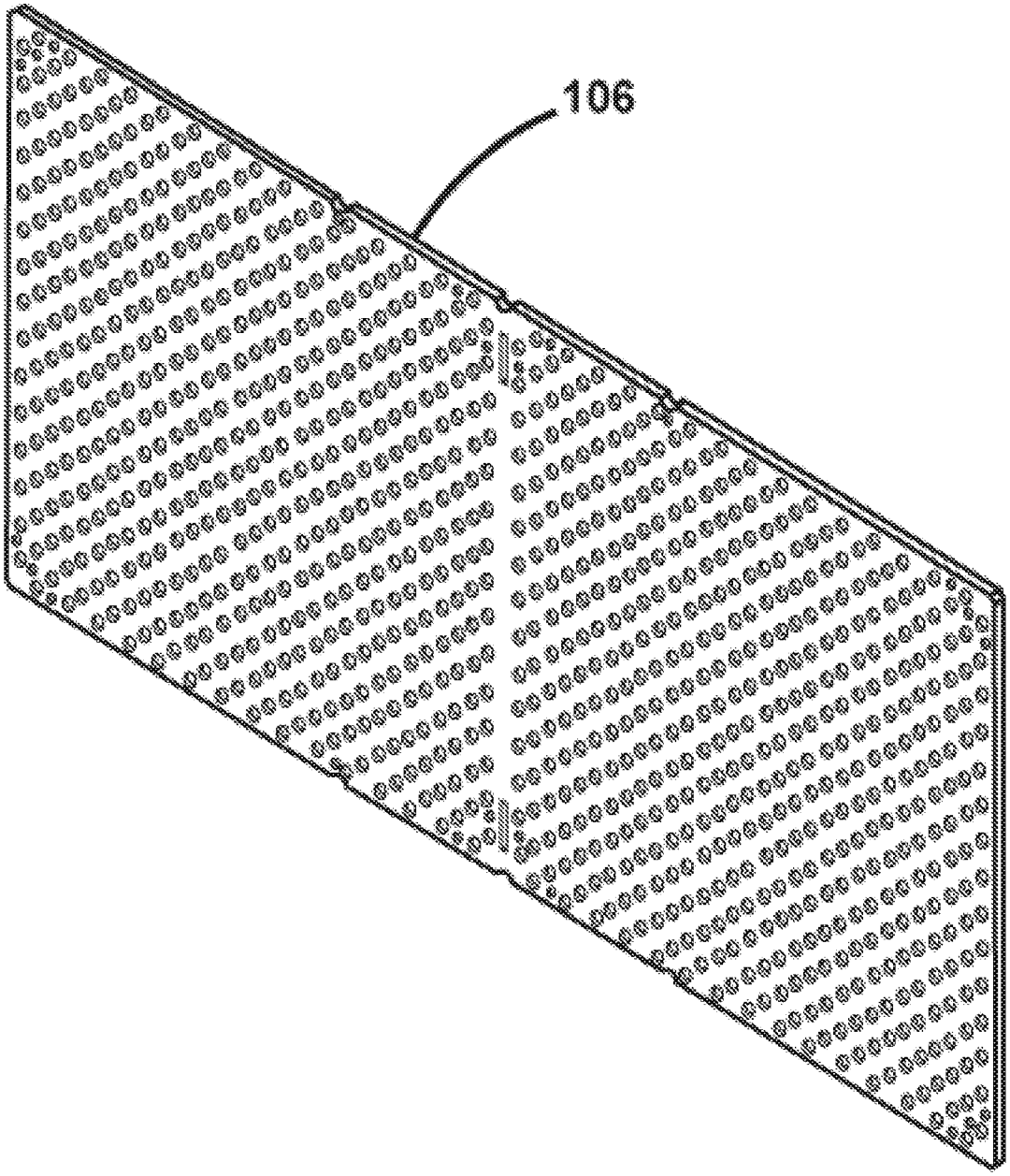
FIG. 13 is a perspective view of a polymeric mat.
Figure 14:
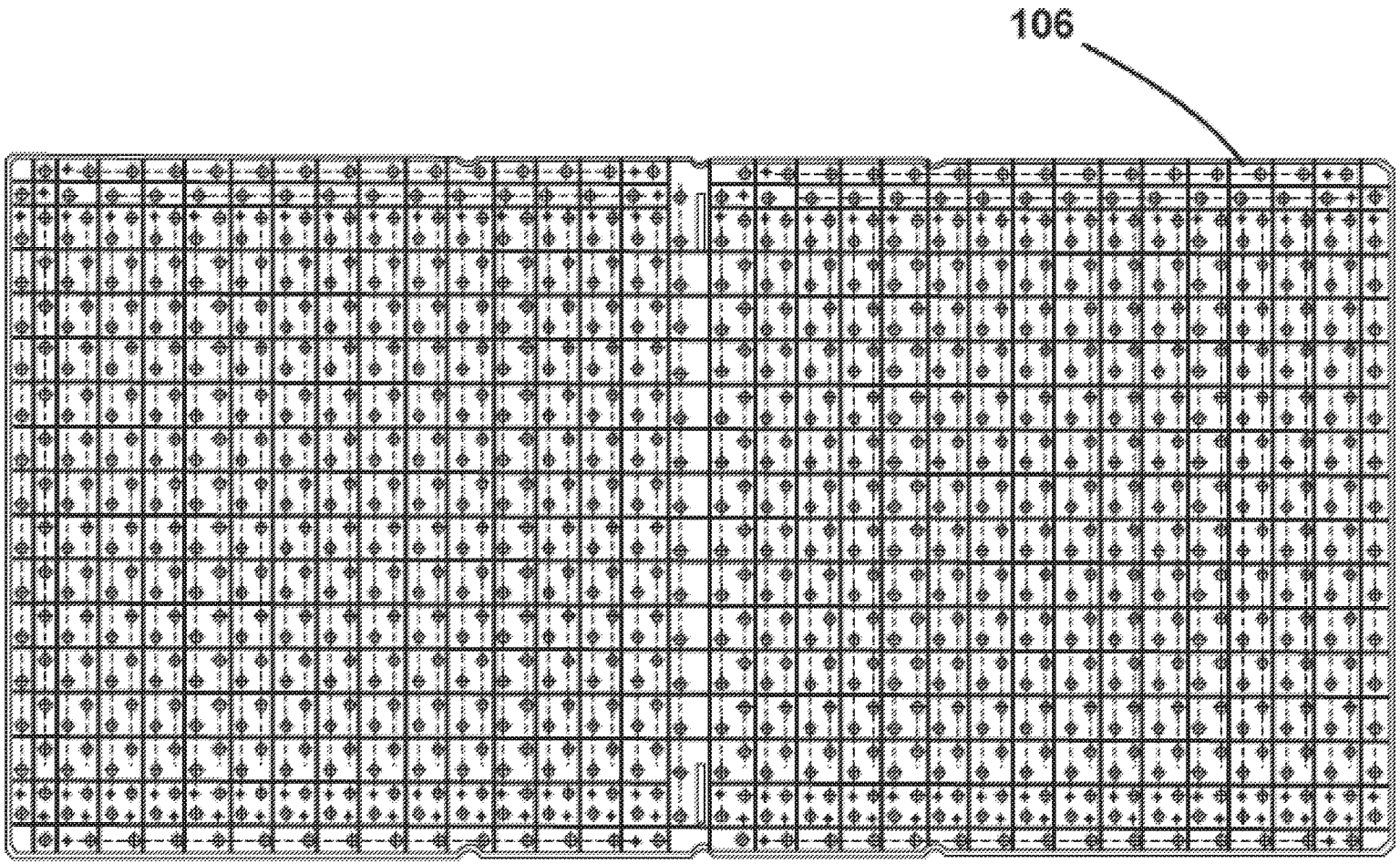
FIG. 14 is a bottom view of a polymeric mat.
Figure 14B:
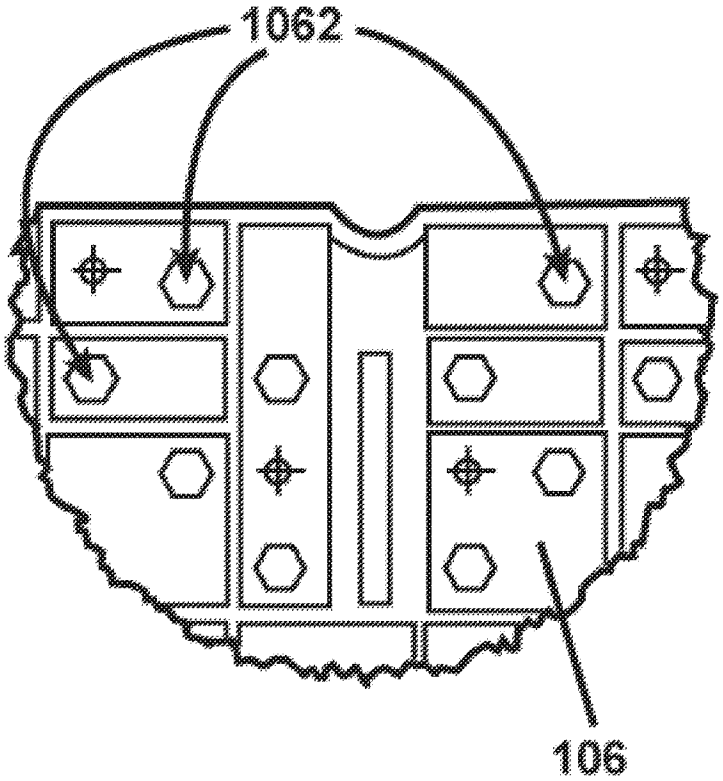
FIG. 14B is a bottom view of a portion of a polymeric mat.
Figure 14A:
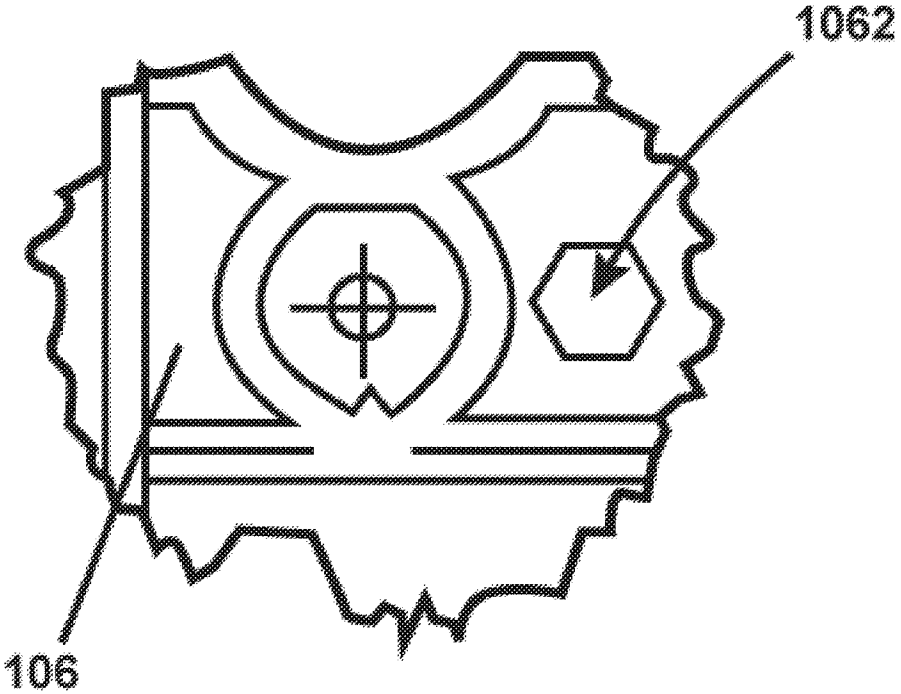
FIG. 14A is a bottom view of a side portion of a polymeric mat.
Figure 15B:
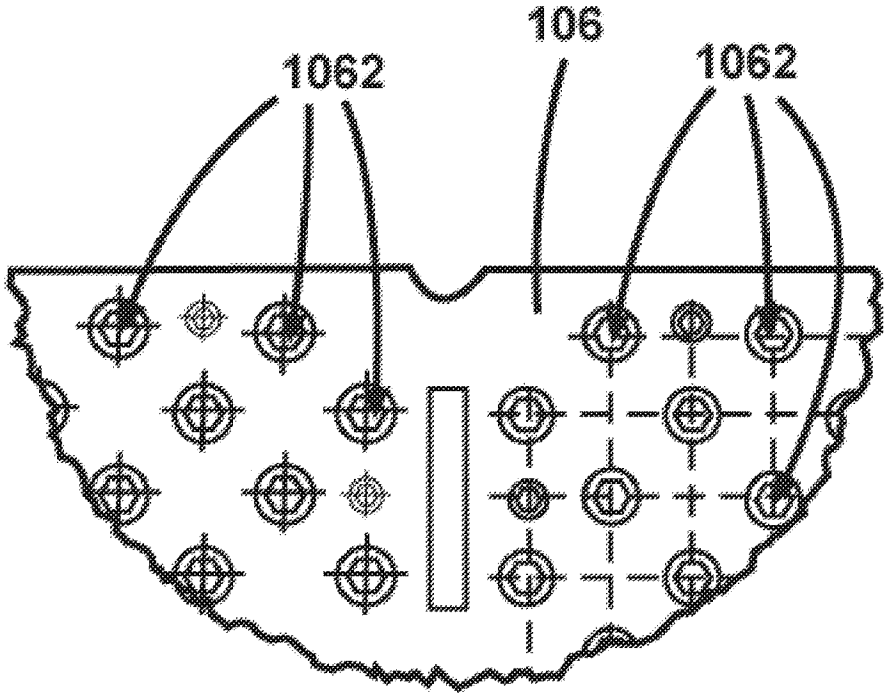
FIG. 15B is a top view of a side portion of a polymeric mat.
Figure 15A:
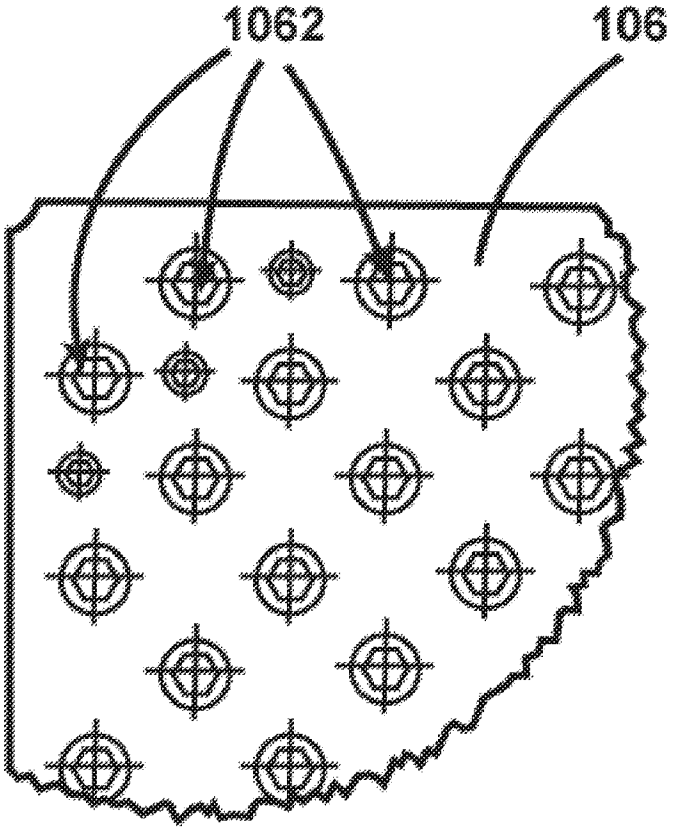
FIG. 15A is a top view of a corner portion of a polymeric mat.
Figure 15D:
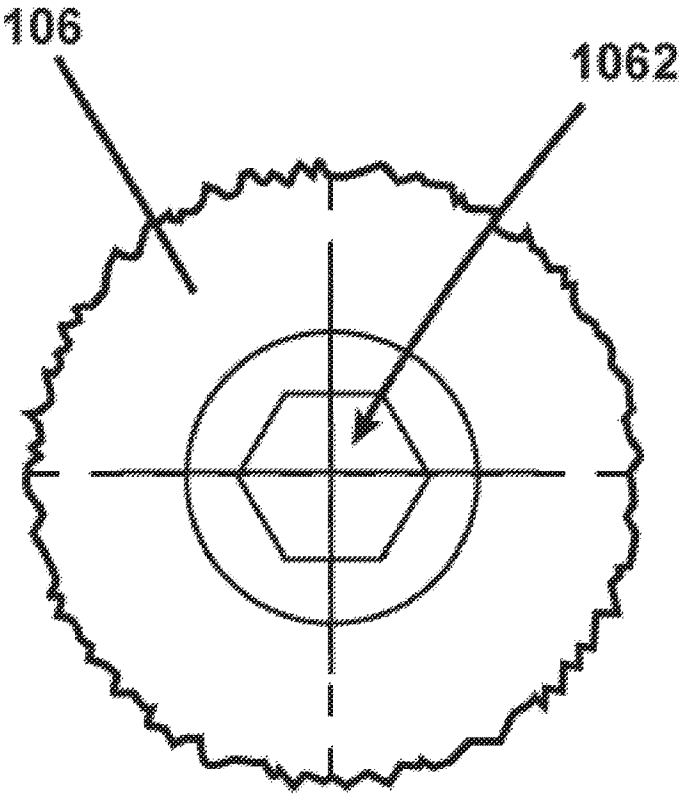
FIG. 15D is a top view of a portion of a polymeric mat.
Figure 15C:
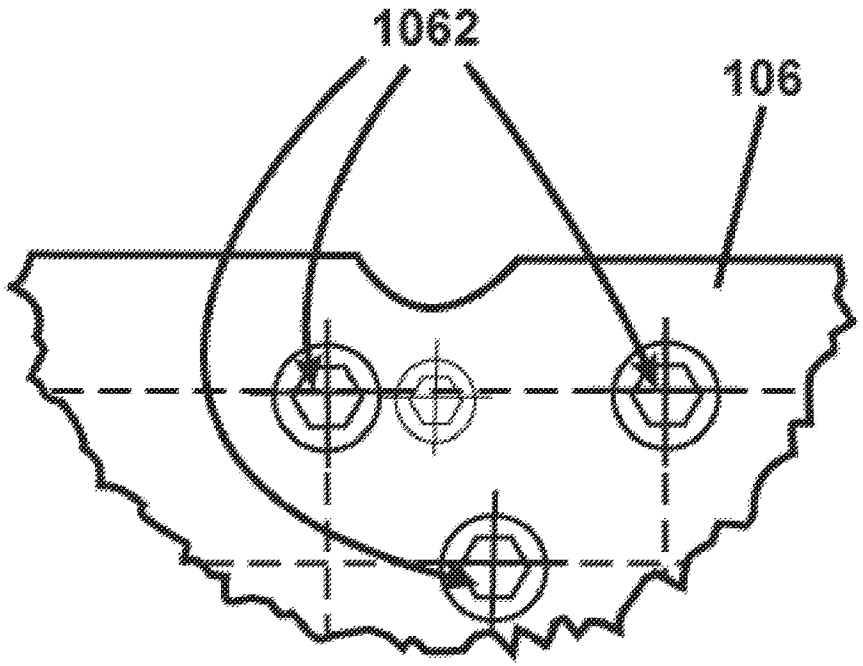
FIG. 15C is a top view of a side portion of a polymeric mat.
Figure 16:
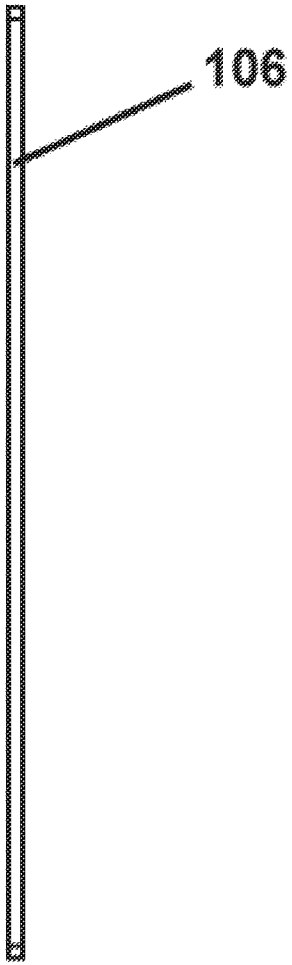
FIG. 16 is a side view of a polymeric mat.

FIGS. 13, 14, 15, and 16 show various views of an additional embodiment of polymeric mat 106; in this embodiment, the cross-sectional area of the polymeric mat 106 is different than the previous embodiment described above. FIG. 13 is a perspective view; FIG. 14 is a bottom view, FIG. 15 is a top view, and FIG. 16 is a side view of the additional embodiment of polymeric mat 106. FIG. 14A is a magnified bottom view of a side-edge portion of an embodiment of polymeric mat 106; specifically shown is hex hole 1062 proximate to a side edge of polymeric mat 106. FIG. 14B is a magnified bottom view of a side portion of an embodiment of polymeric mat 106; specifically shown are a plurality of hex holes 1062 that are configured to enable fasteners to fixably attach polymeric mat 106 to one or more pedestals 110.

Figure 15G:
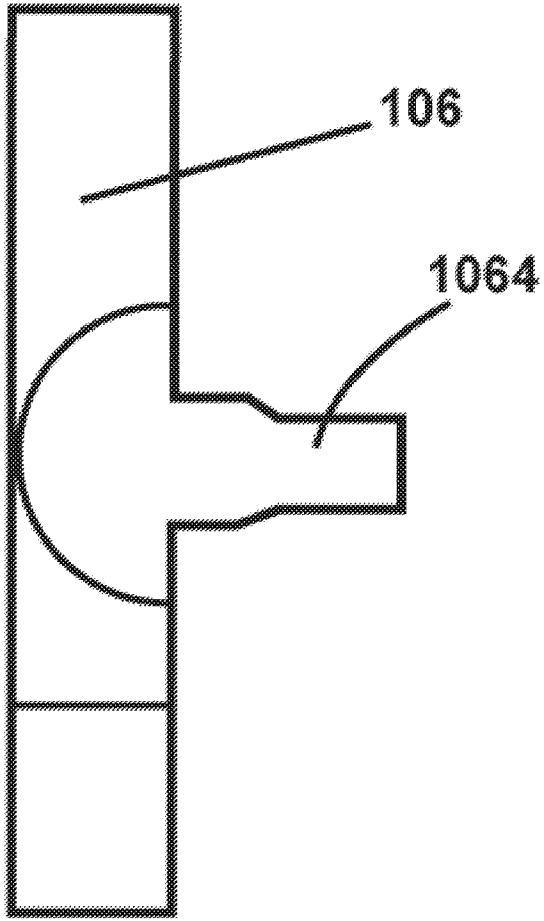
FIG. 15G is a magnified cross-sectional view of a polymeric mat.

FIG. 15A is a magnified top view of a corner portion of an embodiment of polymeric mat 106 having a plurality of hex holes 1062 that are configured to enable fasteners to fixably attach polymeric mat 106 to one or more pedestals 110. FIG. 15B is a magnified top view of a side-edge portion of an embodiment of polymeric mat 106 having a plurality of hex holes 1062 that are configured to enable fasteners to fixably attach polymeric mat 106 to one or more pedestals 110. FIG. 15C is a magnified top view of a side-edge portion of an embodiment of polymeric mat 106 having a plurality of hex holes 1062 that are configured to enable fasteners to fixably attach polymeric mat 106 to one or more pedestals 110. FIG. 15D is a magnified top view of an embodiment of polymeric mat 106 having hex hole 1062 configured to enable a fastener, such as screw or threaded bolt, to fixably attach polymeric mat 106 to a pedestal 110. FIGS. 15E and 15F are cross-sectional views of polymeric mat 106; also shown are a plurality of polymeric ribs 1064 on the underside of polymeric mat 1064. FIG. 15G is a magnified view of a portion of cross-sectional side view shown in 15E, FIG. 15G shows a single polymeric rib 1064 on the underside of polymeric mat 106.

Figure 1A:
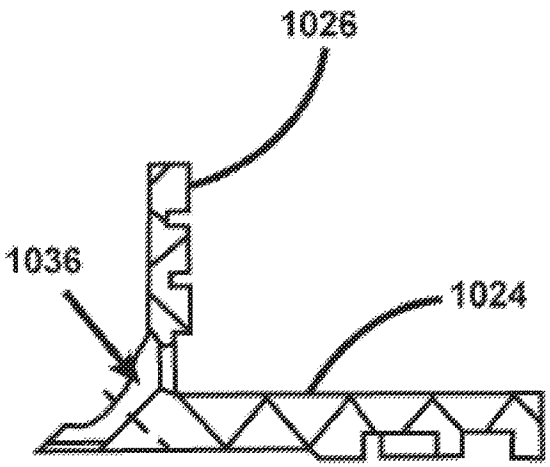
FIG. 1A is a side cross-sectional view of a portion of a polymeric one-piece bracket.
Figure 1:
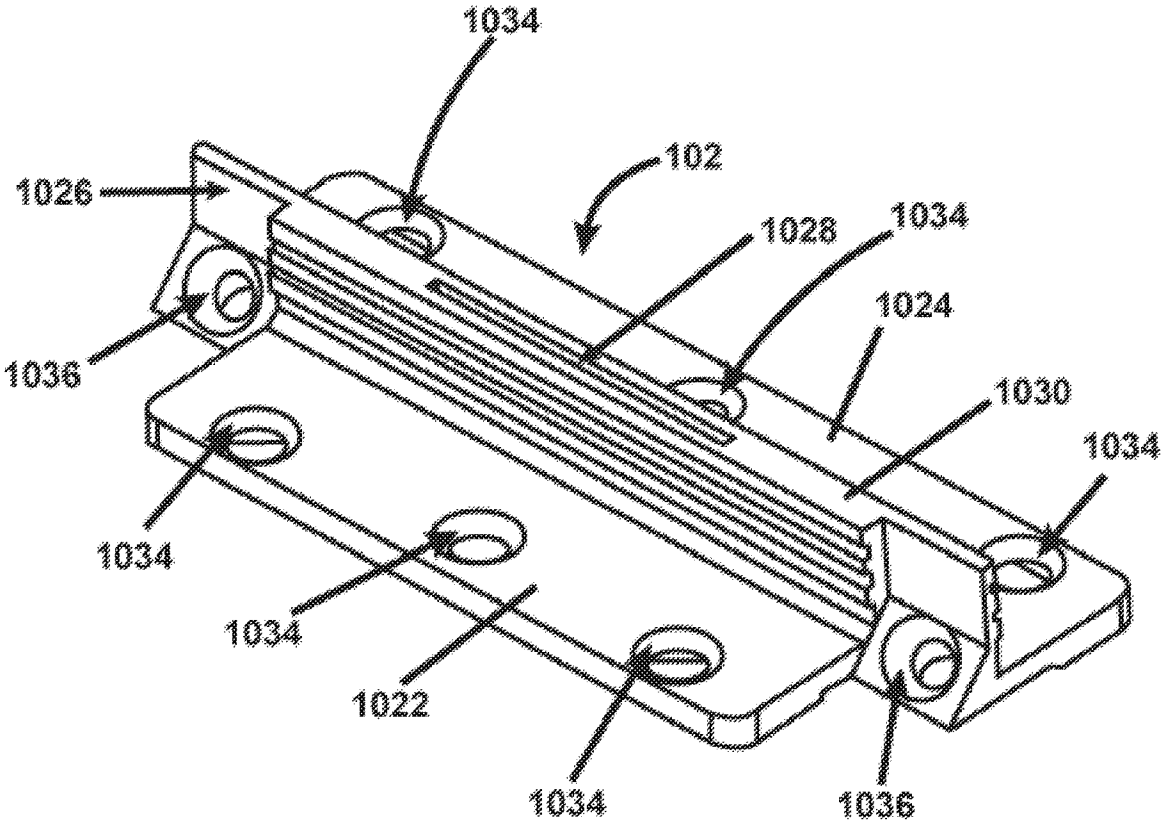
FIG. 1 is a perspective view of a polymeric one-piece bracket.
Figure 2:
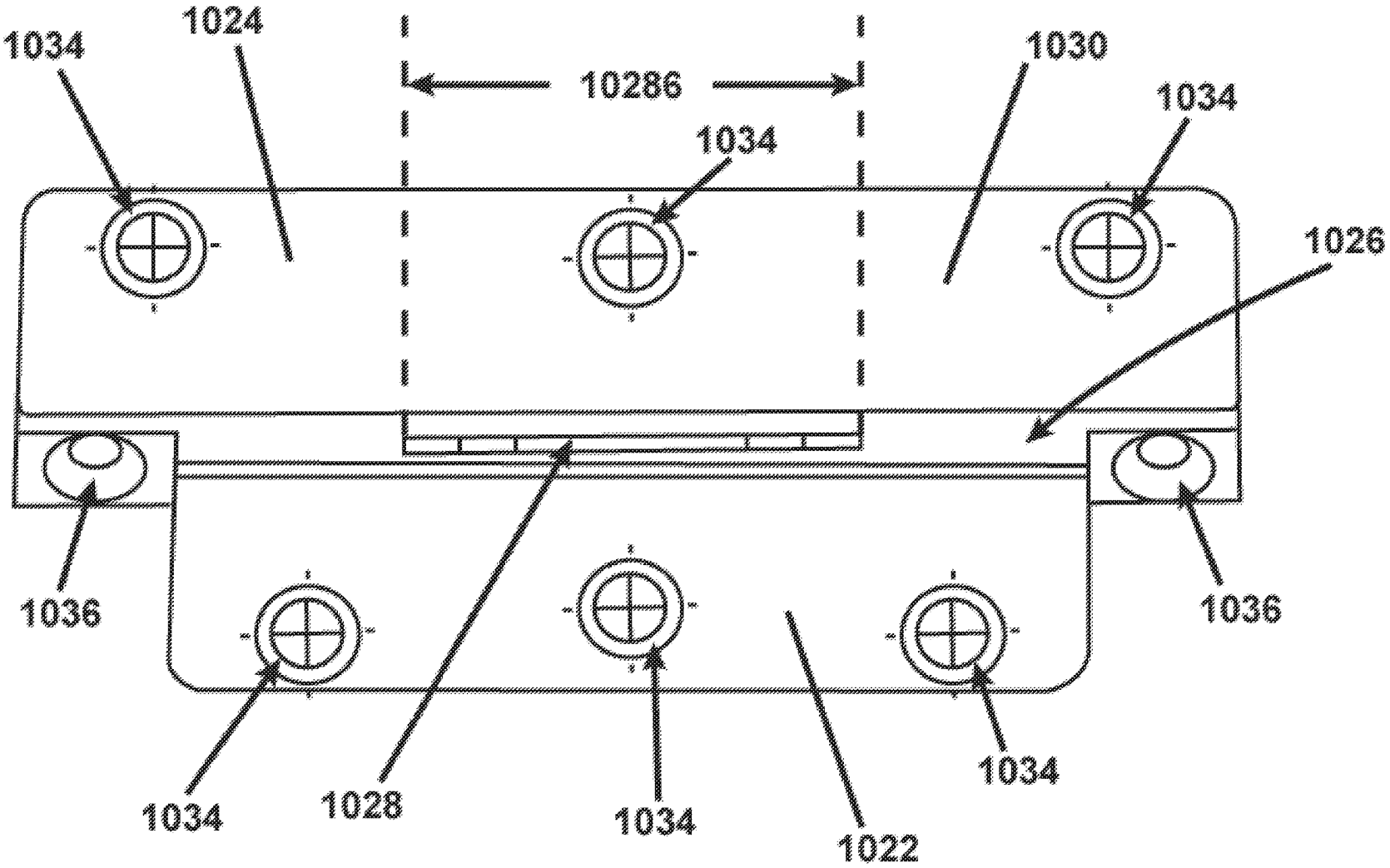
FIG. 2 is a top view of a polymeric one-piece bracket.
Figure 3A:
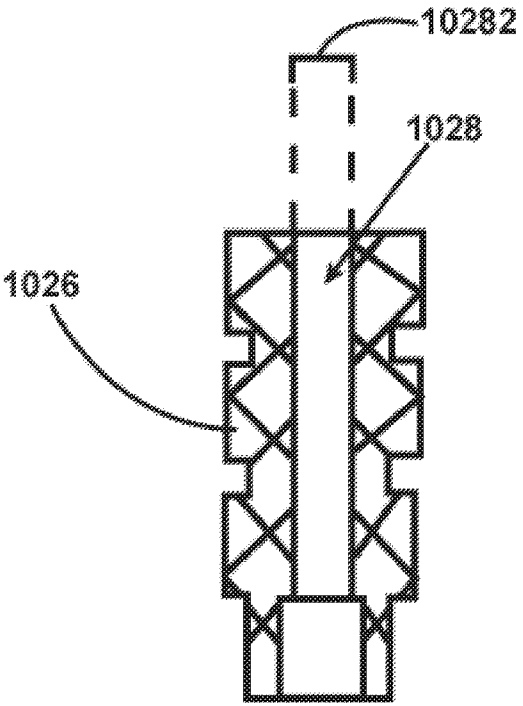
FIG. 3A is a side cross-sectional view of an upper raised-wall portion of a polymeric one-piece bracket.
Figure 3:
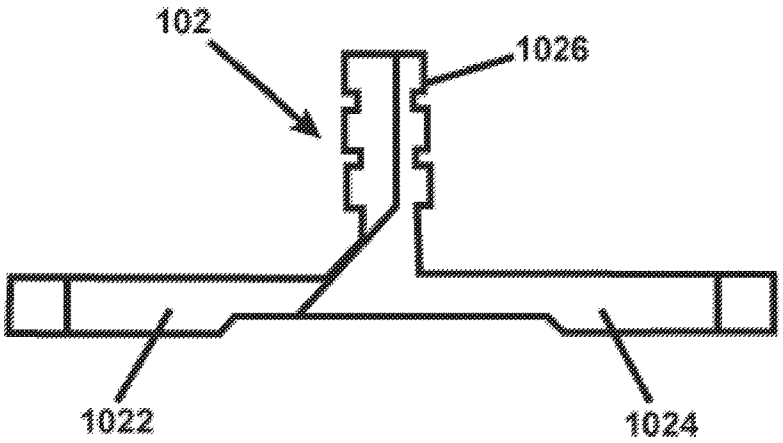
FIG. 3 is a side view of a polymeric one-piece bracket.
Figure 3B:
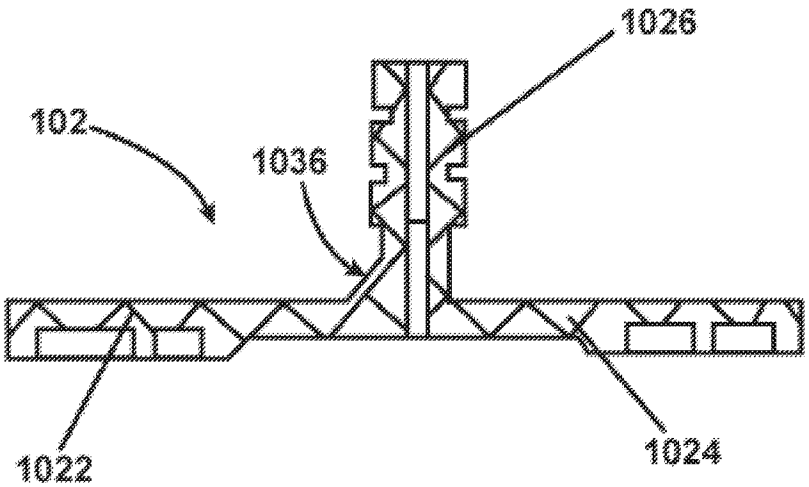
FIG. 3B is a cross-sectional side view of a polymeric one-piece bracket.
Figure 4:
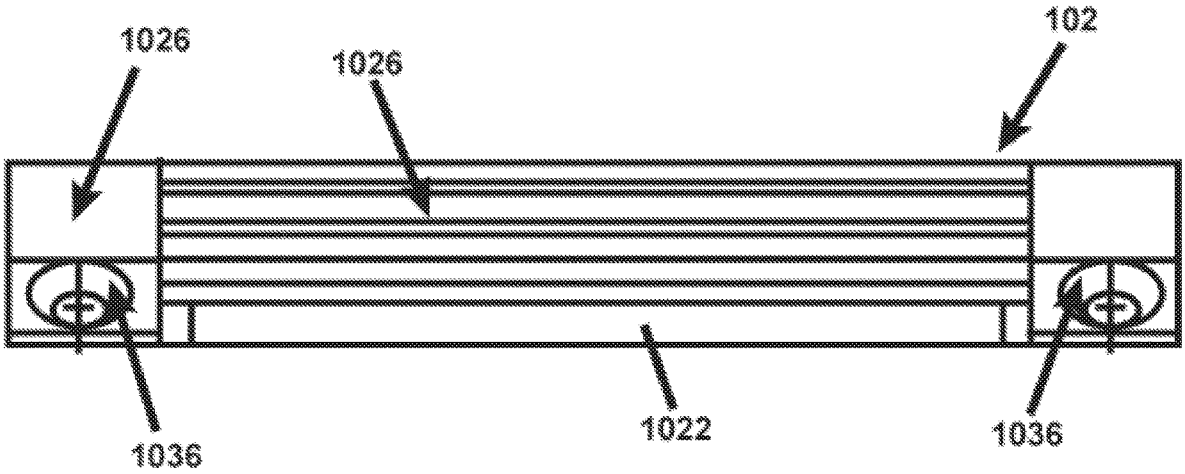
FIG. 4 is a front view of a polymeric one-piece bracket.
Figure 5:
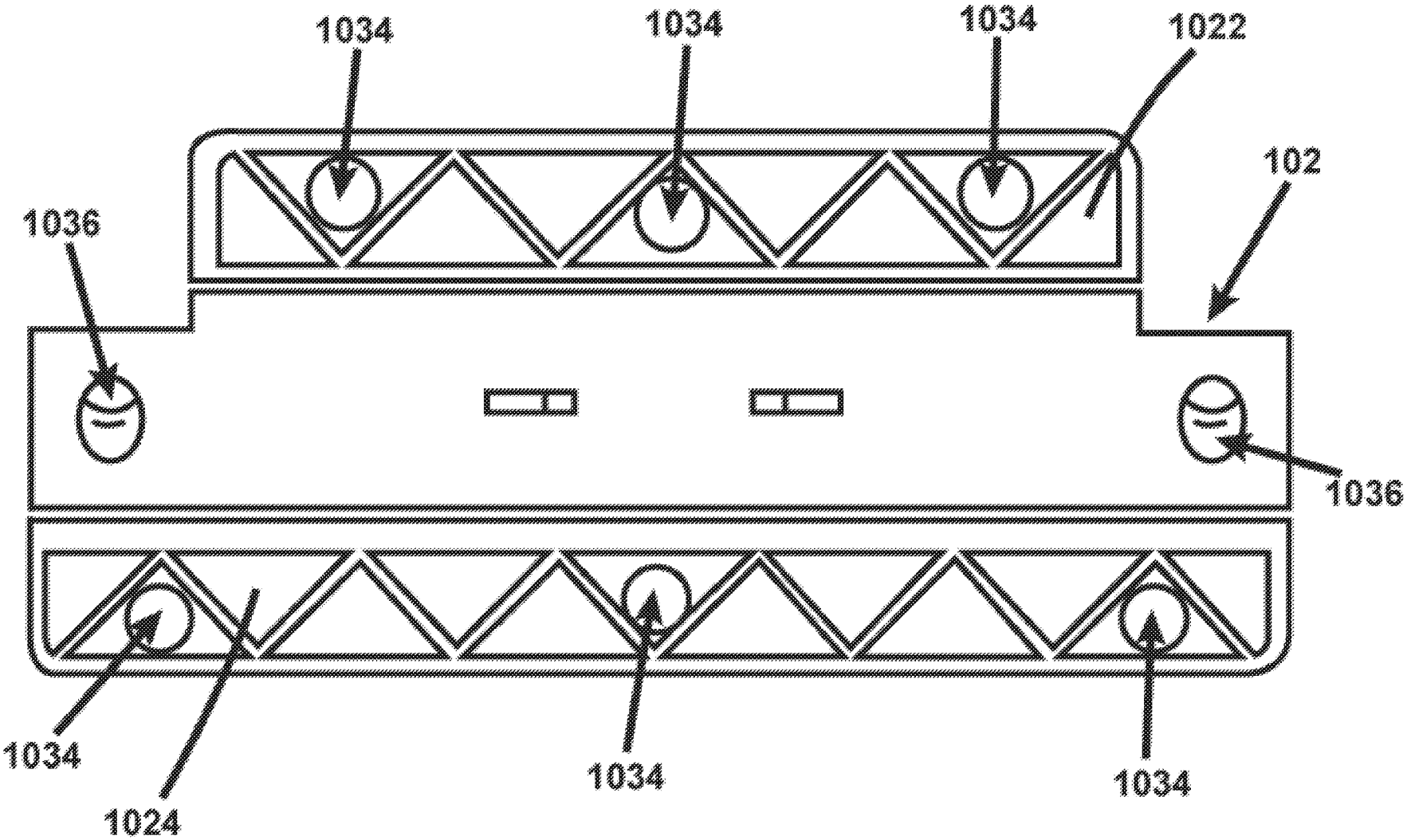
FIG. 5 is a bottom view of a polymeric one-piece bracket.

FIGS. 1, 2, 3, 4, and 5 show various views of polymeric one-piece bracket 102; FIG. 1 is a perspective view; FIG. 2 is a top view; FIG. 3 is a side view; FIG. 4 is a front view; and FIG. 5 is a bottom view. FIG. 1 shows first flange 1022 and second flange 1024 in the same plane and opposing each other; together, these two flanges 1022, 1024 form the base portion of polymeric one-piece bracket 102. In embodiments, first flange 1022 has three flange fastener orifices 1034 and second flange 1024 also has three flange fastener orifices 1034; these flange fastener orifices 1034 are the points of insertion for fasteners that secure polymeric one-piece bracket 102 to polymeric mat 106. In addition to flange fastener orifices 1034, and as shown in the figures, angled fastener orifices 1036 are configured to allow fasteners to enter therein and secure polymeric one-piece bracket 102 to polymeric mat 106. Because of the angled orientation of angled fastener orifices 1036, as fasteners enter into angled fastener orifices 1036 and secure polymeric one-piece bracket to polymeric mat 106, polymeric one-piece bracket 102 is pulled towards tile 108 and pressure is applied against tile 108 thereby securing both polymeric one-piece bracket 102 and respective tile 108 in place. Central raised-wall portion 1026 is orthogonal to and extends along the respective longitudinal lengths of both first flange 1022 and second flange 1024. Slot opening 1028 is positioned on an exterior edge portion of central raised-wall portion 1026, and in an embodiment, slot opening 1028 is a substantially rectangular orifice having a first width 10282 and length 10286 that is configured to receive wedge 104. Upon fully inserting wedge 104 into slot opening 1028, first width 10282 is expanded to a greater second width 10284; the expansion of slot opening 1028 to second width 10284 also expands the width of central raised-wall portion 1026 that (because of its increased width) in turn applies additional pressure against one or more tiles 108 that it is respectively positioned between. To be clear, tile 108 is initially secured in place via pressure that is applied against an edge of tile 108 by polymeric one-piece bracket 102, more specifically, central raised-wall portion 1026 applies pressure to an edge of tile 108 as a fastener is inserted through angled fastener orifice and increasing into polymeric mat 106; then, if, over time or for some other reason, even more pressure is needed to secure adjacent tiles in place, then wedge 104 can be inserted into slot opening 1028 to thereby expand the width of central raised-wall portion 1026. FIG. 1A is a cross-sectional side view of a partial portion of polymeric one-piece bracket 102; shown is a cross section of second flange 1024, central raised-wall portion 1026, and angled fastener orifice 1036; first flange 1022 is notably absent from FIG. 1A. FIG. 2 is a top view of polymeric one-piece bracket 102, and in addition to the elements presented above, slot-opening length 10286 is shown with dotted lines that span from one end of slot opening 1028 to the other. FIG. 3 is a side view of polymeric one-piece bracket 102. FIG. 3A is a magnified cross-sectional side view of a portion of central raised-wall portion 1026 that shows slot-opening 1025 having slot opening first width 10282. FIG. 3B is a cross-sectional side view of a central region of polymeric one-piece bracket 102; shown are first flange 1022, second flange 1024, and central raised-wall portion 1026. FIG. 4 is a front view of polymeric one-piece bracket 102 showing central raised-wall portion 1026, angled fastener orifices 1036, and first flange 1022. FIG. 5 is a bottom view of polymeric one-piece bracket 102 showing angled fastener orifices 1036, fastener orifices 1034, first flange 1022, and second flange 1024.

Figure 4A:
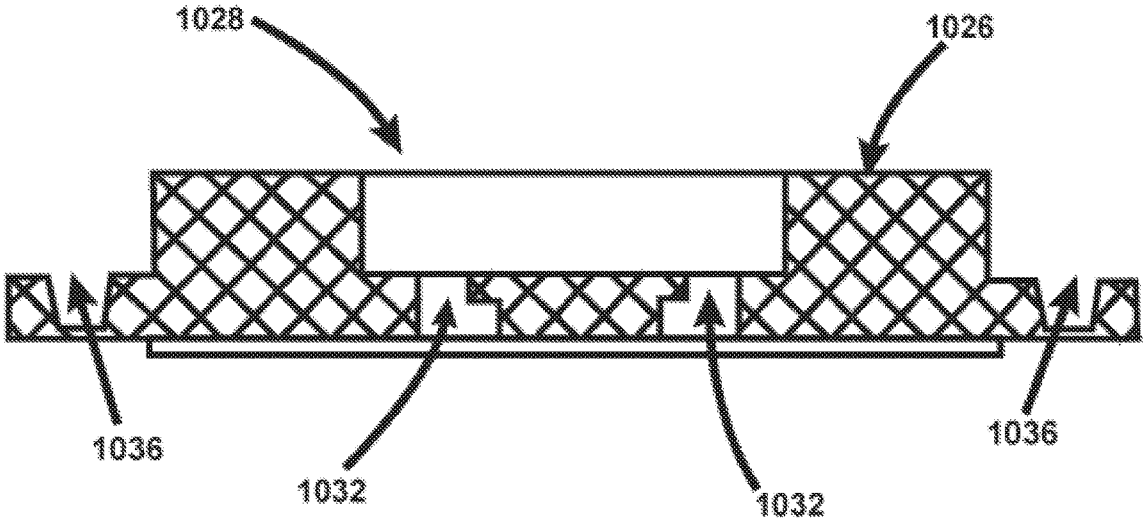
Figure 6:
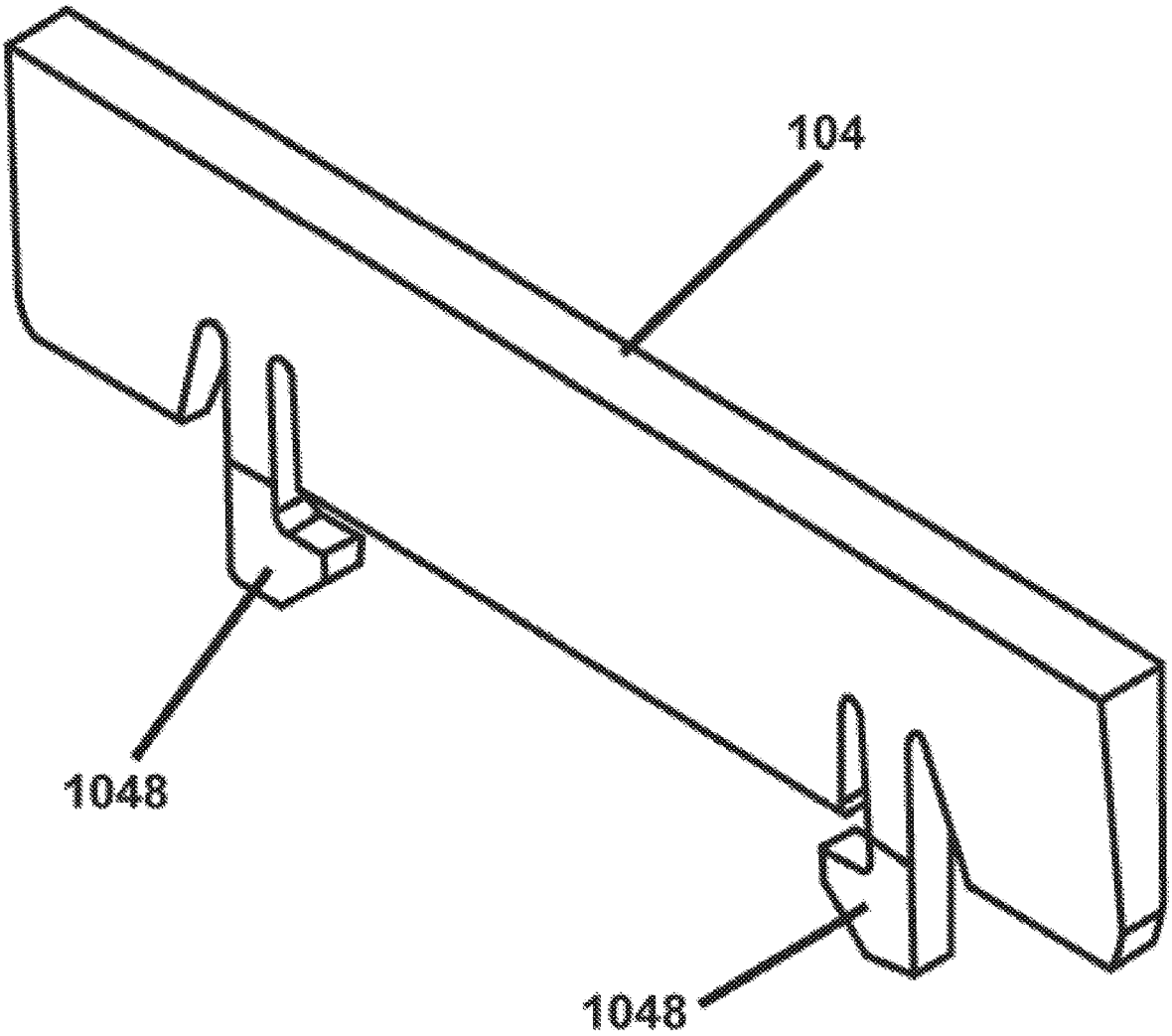
FIG. 6 is a perspective view of a wedge.
Figure 7:
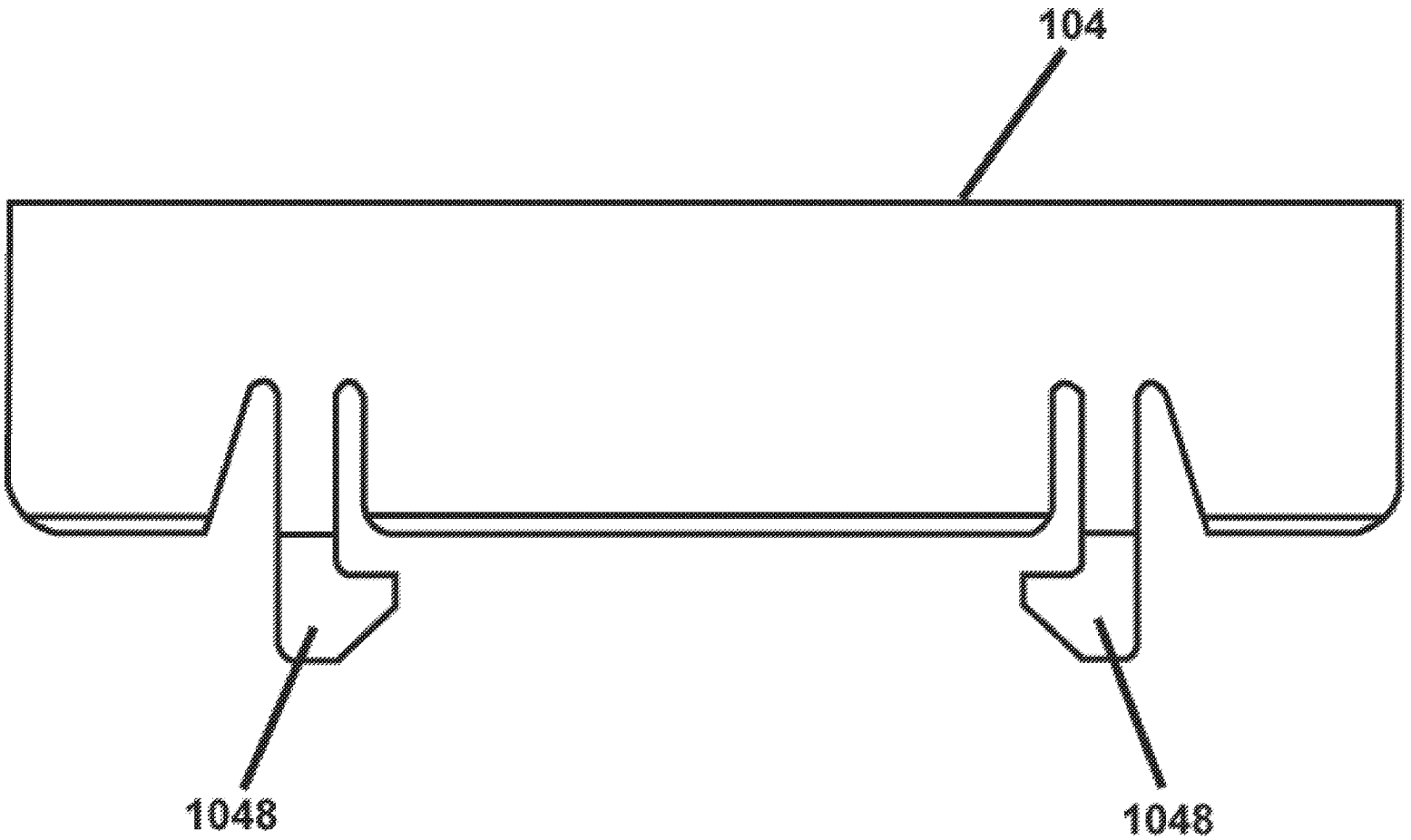
FIG. 7 is a front view of a wedge.
Figure 8:
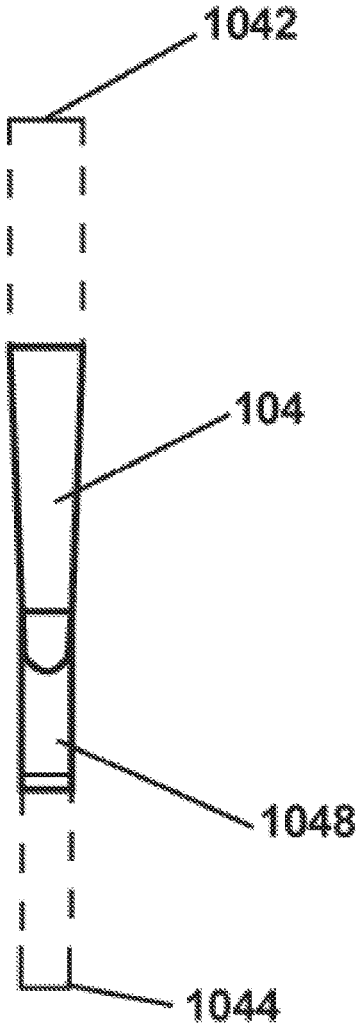
FIG. 8 is a side view of a wedge.
Figure 8A:
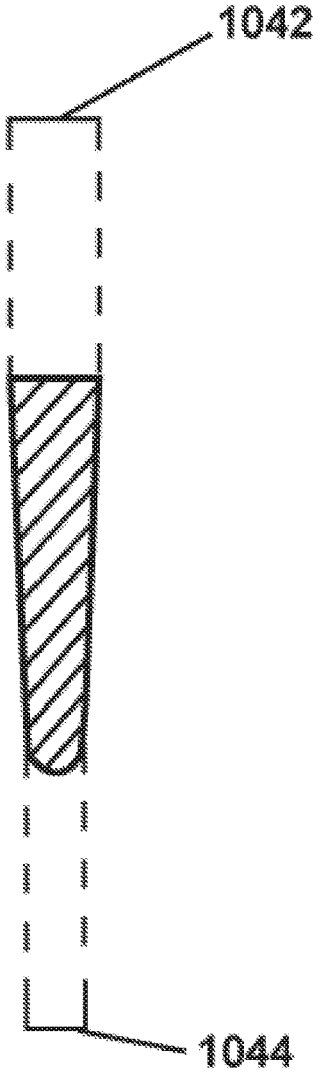
FIG. 8A is side view of a portion of a wedge.

FIG. 6 shows a perspective view of wedge 104 having two insertion feet 1048 that are used to secure wedge 104 within insertion-foot openings 1032 (shown in FIG. 4A). More specifically, insertion feet 1048 are shaped to match the shape of insertion-foot openings 1032; this allows the insertion feet 1048 to effectively mate and lock into place within insertion-foot openings 1032. FIG. 7 is a front view of wedge 104. FIG. 8 is a side view of wedge 104 having upper width 1042 and lower width 1044; and as shown in FIG. 7, the width of wedge 104 tapers from a broader upper width 1042 down to a more narrow lower width 1044, and it's because of this more narrow lower width 1044 that wedge 104 can be initially inserted into slot opening 1028. Lower width 1044 is a width that is less than the first width of slot opening 1028 which allows wedge 104 to be initially inserted into slot opening 1028, and as wedge 104 moves to the fully inserted and locked position (locked by both insertion feet 1048 being inserted into insertion foot openings 1032), the upper width 1042 has a greater width than that of first width 10282 and therefore expands the slot opening first width 10282 to a greater second width 10284. This expansion, that is caused by fully inserting wedge 104 into slot opening 1028, causes the overall width of central raised-wall portion 1026 to increase by expansion, and when central-raised portion 1026 is positioned between tiles 108 (as shown in FIGS. 18A, 18B, 18C, and 18D) this increased width or expansion adds additional pressure against adjacent tiles 108. In an embodiment, after tiles 108 are secured in place as shown in FIGS. 18A, 18B, 18C, and 18D, wedge 104 is then inserted into slot opening 1028 in order to add additional securing pressure against adjacent tiles 108. FIG. 8A is a central cross-sectional side view of wedge 104; shown are upper width 1042 and lower width 1044.

The invention claimed is:

1. A tile-securing system comprising:

a polymeric one-piece bracket having a planar first flange configured to support a tile, a planar second flange configured to support a tile, and a central raised-wall portion, the first flange and the second flange opposing each other and being in the same plane, the central raised-wall portion being orthogonal to both the first flange and the second flange, the first flange abutting a full length of a first side of the central raised-wall portion, the second flange abutting a full length of a second side of the central raised-wall portion, the full length of the first side of the central raised-wall portion being a shorter length than the full length of the second side of the central raised-wall portion;

an angled fastener opening on a first end of the first side of the central raised-wall portion and a second angled fastener opening on a second end of the first side of the central raised-wall portion;

a slot opening located on an exterior edge of the raised-wall portion;

the slot opening having a first width and a first length, wherein the first width is less than the first length, and the slot opening configured to receive a wedge that upon insertion into the slot opening expands the first width to a greater second width.

2. The tile-securing system of claim 1, further comprising:

a wedge that is positioned within the slot opening and fixedly attached to the polymeric one-piece bracket, the wedge having a surface that is flush with the exterior edge of the raised-wall portion.

3. The tile-securing system of claim 2, wherein the wedge has a width that is relatively greater than the first width of the slot opening, and the wedge having a length that is relatively less than the first length of the slot opening.

4. The tile-securing system of claim 3, further comprising a polymeric mat that is fixedly attached to the first flange or second flange.

5. The tile-securing system of claim 4, further comprising at least one tile that is adjacent to and in contact with the polymeric one-piece bracket.

6. The tile-securing system of claim 5, further comprising a pedestal that is fixedly attached to the polymeric mat.

7. A tile-securing system comprising:

a polymeric one-piece bracket having a planar first flange configured to support a tile, a planar second flange configured to support a tile, and a central raised-wall portion, the first flange and the second flange opposing each other and being in the same plane, the central raised-wall portion being orthogonal to both the first flange and the second flange, the first flange abutting a full length of a first side of the central raised-wall portion, the second flange abutting a full length of a second side of the central raised-wall portion, the full length of the first side of the central raised-wall portion being a shorter length than the full length of the second side of the central raised-wall portion;

an angled fastener opening on a first end of the first side of the central raised-wall portion and a second angled fastener opening on a second end of the first side of the central raised-wall portion;

a slot opening located on an exterior edge of the raised-wall portion;

the slot opening having a first width and a first length, the slot opening configured to receive a wedge that upon insertion into the slot expands the first width to a greater second width;

a wedge that is positioned within the slot opening and fixedly attached to the polymeric one-piece bracket, the wedge having a width that is relatively greater than the first width of the slot opening, the wedge having a length that is relatively less than the first length of the slot opening, a polymeric mat that is fixedly attached to the first flange or second flange;

at least one tile that is adjacent to and in contact with the polymeric one-piece bracket; and a pedestal that is fixedly attached to the polymeric mat.

8. The tile-securing system of claim 7, wherein the wedge has a surface that is flush with the exterior edge of the raised-wall portion.

* * * * *